US009338576B2

(12) United States Patent
Schneider et al.

(10) Patent No.: US 9,338,576 B2
(45) Date of Patent: May 10, 2016

(54) APPARATUS AND METHOD FOR LISTENING ROOM EQUALIZATION USING A SCALABLE FILTERING STRUCTURE IN THE WAVE DOMAIN

(71) Applicant: Fraunhofer-Gesellschaft zur Foerderung der Angewandten Forschung e.V., Munich (DE)

(72) Inventors: Martin Schneider, Erlangen (DE); Walter Kellermann, Eckental (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 232 days.

(21) Appl. No.: 14/226,296

(22) Filed: Mar. 26, 2014

(65) Prior Publication Data

US 2014/0294211 A1 Oct. 2, 2014

Related U.S. Application Data

(63) Continuation of application No. PCT/EP2012/068562, filed on Sep. 20, 2012.

(60) Provisional application No. 61/539,855, filed on Sep. 27, 2011.

(30) Foreign Application Priority Data

Mar. 22, 2012 (EP) ..... 12160820

(51) Int. Cl.
*H04S 7/00* (2006.01)

(52) U.S. Cl.
CPC ..... *H04S 7/301* (2013.01); *H04S 2400/09* (2013.01); *H04S 2420/11* (2013.01); *H04S 2420/13* (2013.01)

(58) Field of Classification Search
None
See application file for complete search history.

(56) References Cited

U.S. PATENT DOCUMENTS

2006/0262939 A1 11/2006 Buchner et al.

FOREIGN PATENT DOCUMENTS

JP H11-168792 A 6/1999
JP 2007511148 A 4/2007

OTHER PUBLICATIONS

Benesty, et al., "A better understanding and an improved solution to the specific problems of stereophonic acoustic echo cancellation", IEEE Trans. Speech Audio Process, vol. 6, No. 2, pp. 156-165, Mar. 1998.

(Continued)

*Primary Examiner* — Curtis Kuntz
*Assistant Examiner* — Kenny Truong
(74) *Attorney, Agent, or Firm* — Michael A. Glenn; Perkins Coie LLP

(57) ABSTRACT

An apparatus for listening room equalization is provided. A system identification adaptation unit is configured to adapt a first loudspeaker-enclosure-microphone system identification to obtain a second loudspeaker-enclosure-microphone system identification. A filter adaptation unit is configured to adapt a filter based on the second loudspeaker-enclosure-microphone system identification a predetermined loudspeaker-enclosure-microphone system identification. A filter includes a plurality of subfilters each of which receive one or more of the transformed loudspeaker signals. Each of the subfilters is adapted to generate one of a plurality of filtered loudspeaker signals based on the one or more received loudspeaker signals. At least one of the subfilters is arranged to couple the at least two received loudspeaker signals to generate one of the plurality of the filtered loudspeaker signals. At least one of the subfilters has a number of the received loudspeaker signals that is smaller than a total number of the plurality of transformed loudspeaker signals.

9 Claims, 18 Drawing Sheets

(56) References Cited

OTHER PUBLICATIONS

Berkhout, et al., "Acoustic control by wave field synthesis", J. Acoust. Soc. Am., vol. 93, pp. 2764-2778, May 1993.
Betlehem, et al., "Theory and design of sound field reproduction in reverberant rooms", J. Acoust. Soc. Am., vol. 117, No. 4, pp. 2100-2111, Apr. 2005.
Buchner, et al., "Multichannel Frequency-Domain Adaptive Algorithms with Application to Acoustic Echo Cancellation", In: Benesty, J. (Hrsg.) ; Huang, Y. (Hrsg.): Adaptive Signal Processing: Application to Real-World Problems. Berlin (Springer, 2003).
Buchner, et al., "Robust Extended Multidelay Filter and Double-Talk Detector for Acoustic Echo Cancellation", In: Audio, Speech, and Language Processing, IEEE Transactions on 14 (2006), Nr. 5, S. 1633-1644.
Buchner, et al., "Wave-domain adaptive filtering: acoustic echo cancellation for full-duplex systems based on wave-field synthesis", in Proc. Int. Conf. Acoust. Speech, Signal Process.(ICASSP), May 2004, vol. 4, pp. IV-117-IV-120.
Goetze, et al., "Multi-channel listening-room compensation using a decoupled filtered-X LMS algorithm", in Proc. Asilomar Conference on Signals, Systems and Computers, Oct. 2008, pp. 811-815.
Haykin, et al., "Adaptive filter theory", Chapter 9 of book, Englewood Cliffs, NJ, 2002.
Lopez, et al., "Room compensation in wave field synthesis by means of multichannel inversion", In: Applications of Signal Processing to Audio and Acoustics, 2005. IEEE Workshop on, 2005, S. 146-149.
Nelson, et al., "Inverse filter design and equalization zones in multichannel sound reproduction", IEEE Trans. Speech Audio Process, vol. 3, No. 3, pp. 185-192, May 1995.
Omura, et al., "Compensating of room acoustic transfer functions affected by change of room temperature", In: Acoustics, Speech, and Signal Processing, 1999. ICASSP'99. Proceedings., 1999 IEEE International Conference on Bd. 2 IEEE, 1999, S. 941-944.
Schneider, et al., "A wave-domain model for acoustic MIMO systems with reduced complexity", in Proc. Joint Workshop on Hands-free Speech Communication and Microphone Arrays (HSCMA), Edinburgh, UK, May 2011.
Schneider, Martin et al., "Adaptive listening room equalization using a scalable filtering structure in the wave domain", IEEE International Conference on Acoustics. Speech. and Signal Processing, ICASSP 2012. Mar. 1, 2012. pp. 13-16. XP055044751. Kyoto. Japan. DOI: 10.1109/ICASSP.2012.6287805. ISBN: 978-1-46-730044-5.
Spors, et al., "A novel approach to active listening room compensation for wave field synthesis using wave-domain adaptive filtering", in Proc. Int. Conf. Acoust. Speech, Signal Process (ICASSP), May 2004, vol. 4, pp. IV-29-IV-32.
Spors, et al., "Active Listening Room Compensation for Massive Multichannel Sound Reproduction Systems Using Wave-Domain Adaptive Filtering", In: J. Acoust. Soc. Am. 122 (2007), Jul., Nr. 1, S. 354-369.

APPARATUS AND METHOD FOR LISTENING ROOM EQUALIZATION USING A SCALABLE FILTERING STRUCTURE IN THE WAVE DOMAIN

CROSS-REFERENCE TO RELATED APPLICATIONS

This application is a continuation of copending International Application No. PCT/EP2012/068562, filed Sep. 20, 2012, which is incorporated herein by reference in its entirety, and additionally claims priority from US Application No. 61/539,855, filed Sep. 27, 2011, and European Application No. 12160820.2, filed Mar. 22, 2012, which are all incorporated herein by reference in their entirety.

BACKGROUND OF THE INVENTION

The present invention relates to audio signal processing and, in particular, to an apparatus and method for listening room equalization.

Audio signal processing becomes more and more important. Several audio reproduction techniques, e.g. wave field synthesis (WFS) or Ambisonics, make use of loudspeaker array equipped with a plurality of loudspeakers to provide a highly detailed spatial reproduction of an acoustic scene. In particular, wave field synthesis is used to achieve a highly detailed spatial reproduction of an acoustic scene to overcome the limitations of a sweet spot by using an array of e.g. several tens to hundreds of loudspeakers. More details on wave field synthesis can, for example, be found in:

[1] A. J. Berkhout, D. De Vries, and P. Vogel, "Acoustic control by wave field synthesis", J. Acoust. Soc. Am., vol. 93, pp. 2764-2778, May 1993.

For audio reproduction techniques, such as wave field synthesis (WFS) or Ambisonics, the loudspeaker signals are typically determined according to an underlying theory, so that the superposition of sound fields emitted by the loudspeakers at their known positions describes a certain desired sound field. Typically, the loudspeaker signals are determined assuming free-field conditions. Therefore, the listening room should not exhibit significant wall reflections, because the reflected portions of the reflected wave field would distort the reproduced wave field. In many scenarios, the necessitated acoustic treatment to achieve such room properties may be too expensive or impractical.

An alternative to acoustical countermeasures is to compensate for the wall reflections by means of a listening room equalization (LRE), often termed listening room compensation. Listening room equalization is particularly suitable to be employed with massive multichannel reproduction systems. To this end, the reproduction signals are filtered to pre-equalize the Multiple-Input-Multiple-Output (MIMO) room system response from the loudspeakers at the positions of multiple microphones, ideally achieving an equalization at any point in the listening area. However, the typically large number of reproduction channels of the WFS make the task of listening room equalization challenging for both, computational and algorithmic reasons.

Given a loudspeaker configuration which provides enough control over the wave field, as e.g. used for WFS, it is possible to prefilter the loudspeaker signals in a way so that the desired wave field is reproduced even in the presence of wall reflections. To this end, a microphone array is placed in the listening room and the equalizers are determined in a way so that the resulting overall MIMO system response is equal to the desired (free-field) impulse response (see [3], [10], [11]). As the room properties may change, e.g. due to changes in room temperature, opened doors or by large moving objects in the room, the need for adaptively determined equalizers is created, see, for example:

[12] Omura, M.; Yada, M.; Saruwatari, H.; Kajita, S.; Takeda, K.; Itakura, F.: Compensating of room acoustic transfer functions affected by change of room temperature. In: *Acoustics, Speech, and Signal Processing,* 1999. *ICASSP* '99. Proceedings., 1999 *IEEE International Conference on* Bd. 2 IEEE, 1999, S. 941-944, A corresponding LRE system comprises a building block for identifying the LEMS based on observations of loudspeaker signals and microphone signals and another part for determining the equalizer coefficients, see, e.g. [8]. In the single channel case, it is possible to formulate a direct solution for both, identification and equalizer determination. There are different challenges connected to the task of LRE for multichannel systems: Listening room equalization should be achieved in a spatial continuum and not only at the microphone positions to achieve spatial robustness, see [11]. The problem is often underdetermined or ill-conditioned, and the computational effort for adaptive filtering may be tremendous, see, for example:

[16] Spors, S.; Buchner, H.; Rabenstein, R.; Herbordt, W.: Active Listening Room Compensation for Massive Multichannel Sound Reproduction Systems Using Wave-Domain Adaptive Filtering. In: *J. Acoust. Soc. Am.* 122 (2007), July, Nr. 1, S. 354-369.

Although a loudspeaker array as typically used for WFS provides sufficient control over the wave field to potentially solve the first problem mentioned, the large number of reproduction channels increases the two other mentioned problems, making a system for WFS as presented by [8] unrealistic for typical real-world scenarios.

Although the precise spatial control over the synthesized wave field makes a WFS system particularly suitable for LRE, its many reproduction channels constitute a major challenge for the development of such a system. As the MIMO loudspeaker-enclosure microphone system (LEMS) may be expected to change over time, it has to be continuously identified by adaptive filtering. As known from acoustic echo cancellation (AEC), this problem may be underdetermined or at least ill-conditioned when using multiple reproduction channels, see, for example,

[2] J. Benesty, D. R. Morgan, and M. M. Sondhi, "A better understanding and an improved solution to the specific problems of stereophonic acoustic echo cancellation", IEEE Trans. Speech Audio Process, vol. 6, no. 2, pp. 156-165, March 1998.

Additionally, the inverse filtering problem underlying LRE may be expected to be ill-conditioned as well. Besides these algorithmic problems, the large number of reproduction channels also leads to a large computational effort for both, the system identification and the determination of the equalizing prefilters. As the MIMO system response of the LEMS can only be measured for the microphone positions, and as equalization should be achieved in the entire listening area, the spatial robustness of the solution for the equalizers has to be additionally ensured.

LRE according to the state of the art aims for an equalization at multiple points in the listening room, see, for example,

[11] P. A. Nelson, F. Orduna-Bustamante, and H. Hamada, "Inverse filter design and equalization zones in multichannel sound reproduction", IEEE Trans. Speech Audio Process, vol. 3, no. 3, pp. 185-192, May 1995.

However, this approach disregards the wave propagation, and so, the results obtained suffer from a low spatial robustness.

Wave-domain adaptive filtering (WDAF) (see [7], 15]) was proposed for various adaptive filtering tasks in audio signal processing overcoming the mentioned problems for LRE. This approach uses fundamental solutions of the wave-equation as basis functions for the signal representation for adaptive filtering. As a result, the considered MIMO system may be approximated by multiple decoupled SISO systems (e.g. single channels). This reduces the computational demands for adaptive filtering considerably and additionally improves the conditioning of the underlying problem. At the same time, this approach implicitly considers wave propagation, so solutions are obtained which achieve an LRE within a spatial continuum. See the according patent application:

[6] Buchner, H.; Herbodt, W.; Spors, S; Kellermann, W.: US-Patent Application: Apparatus and Method for Signal Processing. Pub. No.: US 2006 0262939 A1, November 2006.

However, it can be shown that the involved simplified model involving multiple decoupled SISO systems is not able to sufficiently model the LEMS behaviour when a more complex acoustic scene is reproduced, see, for example:

[14] Schneider, M.; Kellermann, W.: A Wave-Domain Model for Acoustic MIMO Systems with Reduced Complexity. In: *Proc. Joint Workshop on Hands-free Speech Communication and Microphone Arrays* (*HSCMA*). Edinburgh, UK, May 2011.

In

[15] S. Spors, H. Buchner, and R. Rabenstein, "A novel approach to active listening room compensation for wave field synthesis using wave-domain adaptive filtering" in Proc. Int. Conf. Acoust. Speech, Signal Process (ICASSP), May 2004, vol. 4, pp. IV-29 IV-32 it is explained that, according to the state of the art, to realize listening room equalization, a number of M loudspeaker input signals are filtered, such that M filtered loudspeaker signals are obtained. Moreover, it is furthermore described in [15], that according to the state of the art, all of the M loudspeaker input signals are taken into account for generating each of the M filtered loudspeaker signals.

Furthermore, in [15] it is proposed as an alternative to such state-of-the-art concepts, that each one of a number of N filtered loudspeaker signals should be generated based on only a single one of the N loudspeaker input signals in the wave domain. By this, a simplified filter structure is achieved. To this end, [15] proposes, that the LEMS may be approximated so that a very simple equalizer structure results. According to the concept proposed in [15], system identification is never an underdetermined problem. However, the model of [15] produces a residual error due to model limitations.

The concept proposed in [15] provides a simplified model that is, due to its simplified structure, realizable in real-word scenarios. However, the simplified structure of this concept also has the disadvantage, that the listening room equalization provided is not sufficient in many practically relevant reproduction scenarios.

SUMMARY

According to an embodiment, an apparatus for listening room equalization, wherein the apparatus is adapted to receive a plurality of loudspeaker input signals, may have: a first transform unit for transforming the at least two loudspeaker input signals from a time domain to a wave domain to obtain a plurality of transformed loudspeaker signals, a system identification adaptation unit for adapting a first loudspeaker-enclosure-microphone system identification to obtain a second loudspeaker-enclosure-microphone system identification, wherein the first and the second loudspeaker-enclosure-microphone system identification identify a loudspeaker-enclosure-microphone system including a plurality of loudspeakers and a plurality of microphones, a filter, wherein the filter includes a plurality of subfilters for generating a plurality of filtered loudspeaker signals, an inverse transform unit for transforming the plurality of filtered loudspeaker signals from the wave domain to the time domain to obtain filtered time-domain loudspeaker signals and for feeding the filtered time-domain loudspeaker signals into the plurality of loudspeakers of the loudspeaker-enclosure-microphone system, a filter adaptation unit for adapting the filter based on the second loudspeaker-enclosure-microphone system identification and based on a predetermined loudspeaker-enclosure-microphone system identification, wherein the system identification adaptation unit is configured to adapt the first loudspeaker-enclosure-microphone system identification based on an error indicating a difference between a plurality of transformed microphone signals and a plurality of estimated microphone signals, wherein the plurality of transformed microphone signals and the plurality of estimated microphone signals depend on the plurality of the filtered loudspeaker signals, wherein the filter is defined by a first matrix $\tilde{G}(n)$, wherein the first matrix $\tilde{G}(n)$ has a plurality of first matrix coefficients, wherein the filter adaptation unit is configured to adapt the filter by adapting the first matrix $\tilde{G}(n)$, and wherein the filter adaptation unit is configured to adapt the first matrix $\tilde{G}(n)$ by setting one or more of the plurality of first matrix coefficients to zero, a second transform unit for receiving a plurality of microphone signals as received by the plurality of microphones and for transforming a plurality of microphone signals of the loudspeaker-enclosure-microphone system from a time domain to a wave domain to obtain the plurality of transformed microphone signals, and a loudspeaker-enclosure-microphone system estimator for generating the plurality of estimated microphone signals based on the first loudspeaker-enclosure-microphone system identification and based on the plurality of the filtered loudspeaker signals, wherein each subfilter of the subfilters is arranged to receive one or more of the transformed loudspeaker signals as received loudspeaker signals of said subfilter, and wherein each subfilter of the subfilters is furthermore adapted to generate one of the plurality of filtered loudspeaker signals based on the one or more received loudspeaker signals of said subfilter, wherein at least one subfilter of the subfilters is arranged to receive at least two of the transformed loudspeaker signals as the received loudspeaker signals of said subfilter, and is furthermore arranged to couple the at least two received loudspeaker signals of said subfilter to generate one of the plurality of the filtered loudspeaker signals of said subfilter, wherein at least one subfilter of the subfilters has a number of the received loudspeaker signals of said subfilter that is smaller than a total number of the plurality of transformed loudspeaker signals, the number of the received loudspeaker signals of said subfilter being one or greater than one, and wherein, when the number of the received loudspeaker signals of a subfilter of the at least one of the subfilters is greater than one, only the received loudspeaker signals of the subfilter of the at least one of the subfilters are coupled to generate the one of the plurality of the filtered loudspeaker signals.

According to another embodiment, a method for listening room equalization may have the steps of: receiving a plurality of loudspeaker input signals, transforming the at least two loudspeaker input signals from a time domain to a wave domain to obtain a plurality of transformed loudspeaker signals, adapting a first loudspeaker-enclosure-microphone system identification to obtain a second loudspeaker-enclosure-microphone system identification, wherein the first and the second loudspeaker-enclosure-microphone system identification identify a loudspeaker-enclosure-microphone system including a plurality of loudspeakers and a plurality of microphones, and adapting a filter based on the second loudspeaker-enclosure-microphone system identification and based on a predetermined loudspeaker-enclosure-microphone system identification, wherein the filter includes a plurality of subfilters, wherein each subfilter of the subfilters is arranged to receive one or more of the transformed loudspeaker signals as received loudspeaker signals of said subfilter, and wherein each subfilter of the subfilters is furthermore adapted to generate one of a plurality of filtered loudspeaker signals based on the one or more received loudspeaker signals of said subfilter, and wherein adapting the first loudspeaker-enclosure-microphone system identification is conducted based on an error indicating a difference between a plurality of transformed microphone signals and a plurality of estimated microphone signals, wherein the plurality of transformed microphone signals and the plurality of estimated microphone signals depend on the plurality of the filtered loudspeaker signals, wherein the filter is defined by a first matrix $\tilde{G}(n)$, wherein the first matrix $\tilde{G}(n)$ has a plurality of first matrix coefficients, wherein adapting the filter is conducted by adapting the first matrix $\tilde{G}(n)$, and wherein the filter adaptation unit is configured to adapt the first matrix $\tilde{G}(n)$ by setting one or more of the plurality of first matrix coefficients to zero, transforming a plurality of microphone signals received by the plurality of microphones of the loudspeaker-enclosure-microphone system from a time domain to a wave domain to obtain the plurality of transformed microphone signals, and generating the plurality of estimated microphone signals based on the first loudspeaker-enclosure-microphone system identification and based on the plurality of the filtered loudspeaker signals, wherein at least one subfilter of the subfilters is arranged to receive at least two of the transformed loudspeaker signals as the received loudspeaker signals of said subfilter, and is furthermore arranged to couple the at least two received loudspeaker signals to generate one of the plurality of the filtered loudspeaker signals, wherein at least one subfilter of the subfilters has a number of the received loudspeaker signals of said subfilter that is smaller than a total number of the plurality of transformed loudspeaker signals, the number of the received loudspeaker signals of said subfilter being one or greater than one, and wherein, when the number of the received loudspeaker signals of a subfilter of the at least one of the subfilters is greater than one, only the received loudspeaker signals of the subfilter of the at least one of the subfilters are coupled to generate the one of the plurality of the filtered loudspeaker signals.

Another embodiment may have a computer program for implementing an inventive method when being executed by a computer or processor.

In an embodiment, an apparatus for listening room equalization is provided. The apparatus is adapted to receive a plurality of loudspeaker input signals.

The apparatus comprises a transform unit being adapted to transform the at least two loudspeaker input signals from a time domain to a wave domain to obtain a plurality of transformed loudspeaker signals.

Moreover, the apparatus comprises a system identification adaptation unit being configured to adapt a first loudspeaker-enclosure microphone system identification to obtain a second loudspeaker-enclosure microphone system identification. The first and the second loudspeaker-enclosure microphone system identification identify a loudspeaker-enclosure microphone system comprising a plurality of loudspeakers and a plurality of microphones.

Furthermore, the apparatus comprises a filter adaptation unit being configured to adapt a filter based on the second loudspeaker-enclosure microphone system identification and based on a predetermined loudspeaker-enclosure microphone system identification.

The filter comprises a plurality of subfilters. Each of the subfilters is arranged to receive one or more of the transformed loudspeaker signals as received loudspeaker signals. Each of the subfilters is furthermore adapted to generate one of a plurality of filtered loudspeaker signals based on the one or more received loudspeaker signals. At least one of the subfilters is arranged to receive at least two of the transformed loudspeaker signals as the received loudspeaker signals, and is furthermore arranged to couple the at least two received loudspeaker signals to generate one of the plurality of the filtered loudspeaker signals. At least one of the subfilters has a number of the received loudspeaker signals that is smaller than a total number of the plurality of transformed loudspeaker signals, wherein the number of the received loudspeaker signals is 1 or greater than 1.

In the above-described embodiment, as each of the subfilters of the filter generates exactly one filtered loudspeaker signal, the filter outputs the same number of filtered loudspeaker signals as the filter has subfilters.

According to the present invention, improved concepts for listening room equalization for a flexible LEMS model are provided and also a flexible equalizer structure. Compared to the approach in [15], the concept inter alia provides a more flexible LEMS model combined with a more flexible equalizer structure. Compared to other state of the art, a concept is provided that can be realized in real-world scenarios, as the concept does necesitate significantly less computation time than the concepts that take all loudspeaker input signals into account for generating each of the filtered loudspeaker signals. To this end, the present invention provides a loudspeaker-enclosure microphone system identification is provided that is sufficiently simple such that real-world scenarios can be realized, but also sufficiently complex for providing sufficient listening room equalization.

Embodiments allow that the complexity of both the listening room equalization as well as the equalizer structure can be chosen such that a trade-off between the suitability for different complex reproduction scenarios on one side and robustness and computational demands on the other side is realized. The number of degrees of freedom can be flexibly chosen. By the improved concepts for WDAF, an adaptive LRE is provided for a broad range of reproduction scenarios, which maintains the advantages of wave-domain adaptive filtering.

According to an apparatus of a further embodiment, the filter may be configured such that for each subfilter which is arranged to receive a number of transformed loudspeaker signals as the received loudspeaker signals that is greater than 1, only the received loudspeaker signals may be coupled to generate one of the plurality of filtered loudspeaker signals.

In an embodiment, a filter adaptation unit is provided that allows to choose the complexity of the equalizer structure and the LEMS model adaptively depending on the complexity of the reproduced scene.

According to an embodiment, the filter adaptation unit may be configured to determine a filter coefficient for each pair of at least three pairs of a loudspeaker signal pair group to obtain a filter coefficients group, the loudspeaker signal pair group comprising all loudspeaker signal pairs of one of the transformed loudspeaker signals and one of the filtered loudspeaker signals, wherein the filter coefficients group has fewer filter coefficients than the loudspeaker signal pair group has loudspeaker signal pairs, and wherein the filter adaptation unit is configured to adapt the filter by replacing filter coefficients of the filter by at least one of the filter coefficients of the filter coefficients group.

In a further embodiment, the filter adaptation unit may be configured to determine a filter coefficient for each pair of a loudspeaker signal pair group to obtain a first filter coefficients group, the loudspeaker signal pair group comprising all loudspeaker signal pairs of one of the transformed loudspeaker signals and one of the filtered loudspeaker signals, wherein the filter adaptation unit is configured to select a plurality of filter coefficients from the first filter coefficients group to obtain a second filter coefficients group, the second filter coefficients group having fewer filter coefficients than the first filter coefficients group, and wherein the filter adaptation unit is configured to adapt the filter by replacing filter coefficients of the filter by at least one of the filter coefficients of the second filter coefficients group.

According to another embodiment, each of the subfilters may be adapted to generate exactly one of the plurality of the filtered loudspeaker signals.

According to a further embodiment, all subfilters of the filter receive the same number of transformed loudspeaker signals.

In another embodiment, the filter may be defined by a first matrix $\tilde{G}(n)$, wherein the first matrix $\tilde{G}(n)$ has a plurality of first matrix coefficients, wherein the filter adaptation unit is configured to adapt the filter by adapting the first matrix $\tilde{G}(n)$, and wherein the filter adaptation unit is configured to adapt the first matrix $\tilde{G}(n)$ by setting one or more of the plurality of first matrix coefficients to zero.

In a further embodiment, the filter adaptation unit may be configured to adapt the filter based on the equation $$\tilde{H}(n)\tilde{G}(n)=\tilde{H}^{(0)}$$

wherein $\tilde{H}(n)$ is a second matrix indicating the second loudspeaker-enclosure microphone system identification, and wherein $\tilde{H}^{(0)}$ is a third matrix indicating the predetermined loudspeaker-enclosure microphone system identification.

According to another embodiment, wherein the second matrix $\tilde{H}(n)$ may have a plurality of second matrix coefficients, and wherein second system identification adaptation unit is configured to determine the second matrix $\tilde{H}(n)$ by setting one or more of the plurality of second matrix coefficients to zero.

According to a further embodiment, the apparatus furthermore may comprise an inverse transform unit for transforming the filtered loudspeaker signals from the wave domain to the time domain to obtain filtered time-domain loudspeaker signals.

In a further embodiment, the system identification adaptation unit may be configured to adapt the first loudspeaker-enclosure microphone system identification based on an error indicating a difference between a plurality of transformed microphone signals ($\tilde{d}(n)$) and a plurality of estimated microphone signals ($\tilde{y}(n)$), wherein the plurality of transformed microphone signals ($\tilde{d}(n)$) and the plurality of estimated microphone signals ($\tilde{y}(n)$) depend on the plurality of the filtered loudspeaker signals.

According to a further embodiment, the transform unit may be a first transform unit, and wherein the apparatus furthermore may comprise a second transform unit for transforming a plurality of microphone signals received by the plurality of microphones of the loudspeaker-enclosure microphone system from a time domain to a wave domain to obtain the plurality of transformed microphone signals.

According to another embodiment, the apparatus may furthermore comprise a loudspeaker-enclosure microphone system estimator for generating the plurality of estimated microphone signals ($\tilde{y}(n)$) based on the first loudspeaker-enclosure microphone system identification and based on the plurality of the filtered loudspeaker signals.

In another embodiment, the apparatus furthermore may comprise an error determiner for determining the error indicating the difference between the plurality of transformed microphone signals ($\tilde{d}(n)$) and the plurality of estimated microphone signals ($\tilde{y}(n)$) by applying the formula $$\tilde{e}(n)=\tilde{d}(n)-\tilde{y}(n)$$

to determine the error, and wherein the error determiner may be arranged to feed the determined error into the system identification adaptation unit.

According to another embodiment, a method for listening room equalization is provided.

The method comprises:

1) receiving a plurality of loudspeaker input signals,
2) transforming the at least two loudspeaker input signals from a time domain to a wave domain to obtain a plurality of transformed loudspeaker signals,
3) adapting a first loudspeaker-enclosure microphone system identification to obtain a second loudspeaker-enclosure microphone system identification, wherein the first and the second loudspeaker-enclosure microphone system identification identify a loudspeaker-enclosure microphone system comprising a plurality of loudspeakers and a plurality of microphones, and
4) adapting a filter based on the second loudspeaker-enclosure microphone system identification and based on a predetermined loudspeaker-enclosure-micro microphone system identification.

The filter comprises a plurality of subfilters, wherein each of the subfilters is arranged to receive one or more of the transformed loudspeaker signals as received loudspeaker signals, and wherein each of the subfilters is furthermore adapted to generate one of a plurality of filtered loudspeaker signals based on the one or more received loudspeaker signals.

At least one of the subfilters is arranged to receive at least two of the transformed loudspeaker signals as the received loudspeaker signals, and is furthermore arranged to couple the at least two received loudspeaker signals to generate one of the plurality of the filtered loudspeaker signals. Moreover, at least one of the subfilters has a number of the received loudspeaker signals that is smaller than a total number of the plurality of transformed loudspeaker signals, wherein the number of the received loudspeaker signals is 1 or greater than 1.

According to a method of a further embodiment, the filter may be configured such that for each subfilter which is arranged to receive a number of transformed loudspeaker signals as the received loudspeaker signals that is greater than 1, only the received loudspeaker signals may be coupled to generate one of the plurality of filtered loudspeaker signals.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
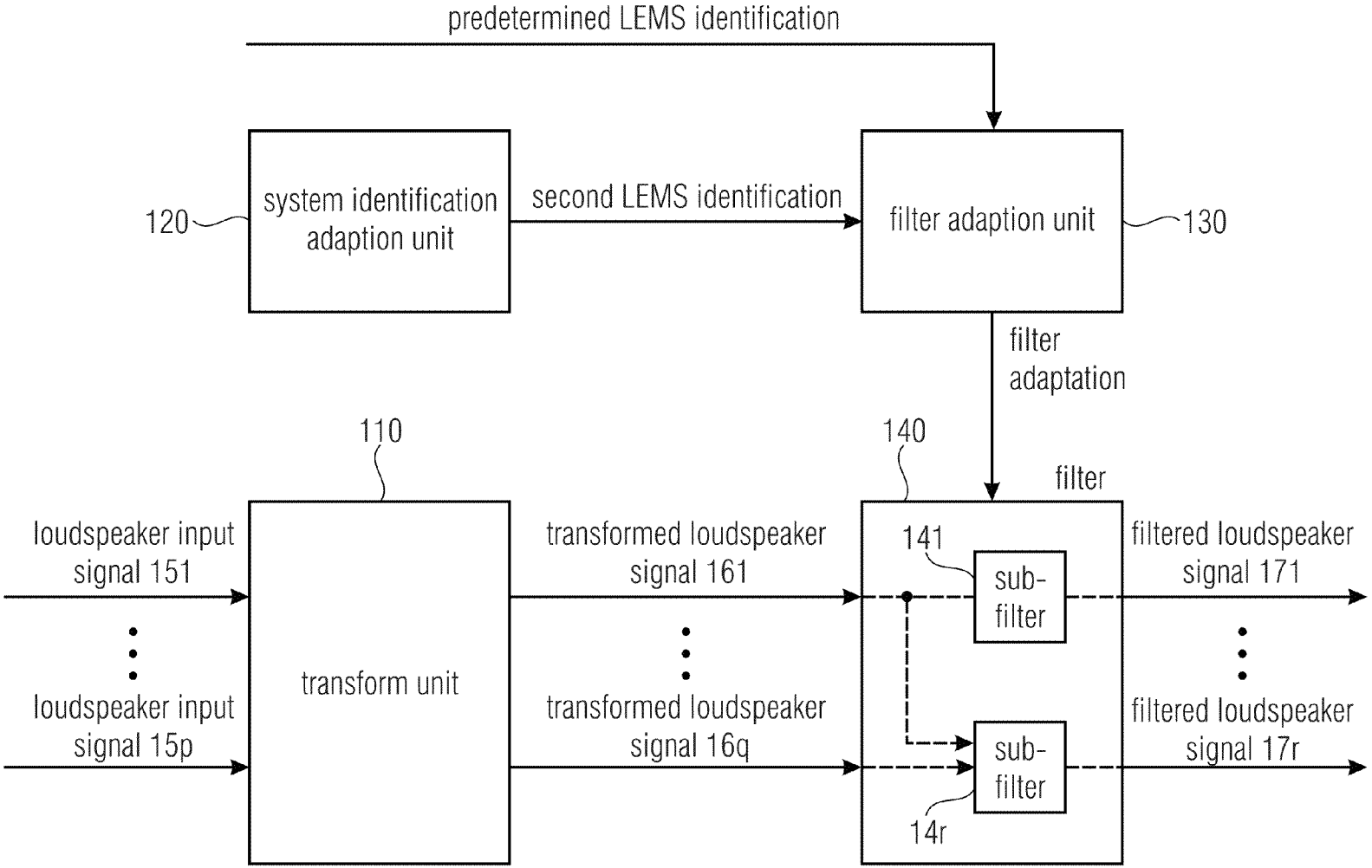
FIG. 1 illustrates an apparatus for listening room equalization according to an embodiment.

FIG. 1 illustrates an apparatus for listening room equalization according to an embodiment. The apparatus for listening room equalization comprises a transform unit 110, a system identification adaptation unit 120 and a filter adaptation unit 130.

The transform unit 110 is adapted to transform a plurality of loudspeaker input signals 151, . . . , 15*p* from a time domain to a wave domain to obtain a plurality of transformed loudspeaker signals 161, . . . , 16*q*.

The system identification adaptation unit 120 is configured to adapt a first loudspeaker-enclosure-microphone system identification to obtain a second loudspeaker-enclosure microphone system identification (second LEMS identification).

The filter adaptation unit 130 is configured to adapt a filter 140 based on the second loudspeaker-enclosure-microphone system identification and based on a predetermined loudspeaker-enclosure-microphone system identification. The filter 140 comprises a plurality of subfilters 141, . . . , 14*r* each of which receives one or more of the transformed loudspeaker signals 161, . . . , 16*q*. Each of the subfilters 141, . . . , 14*r* is adapted to generate one of a plurality of filtered loudspeaker signals 171, . . . , 17*r* based on the one or more received loudspeaker signals. At least one of the subfilters 141, . . . , 14*r* is arranged to couple the at least two received loudspeaker signals to generate one of the plurality of the filtered loudspeaker signals 171, . . . , 17*r*. Moreover, at least one of the subfilters 141, . . . , 14*r* has a number of the received loudspeaker signals that is smaller than a total number of the plurality of transformed loudspeaker signals 161, . . . , 16*q*.

Figure 2:
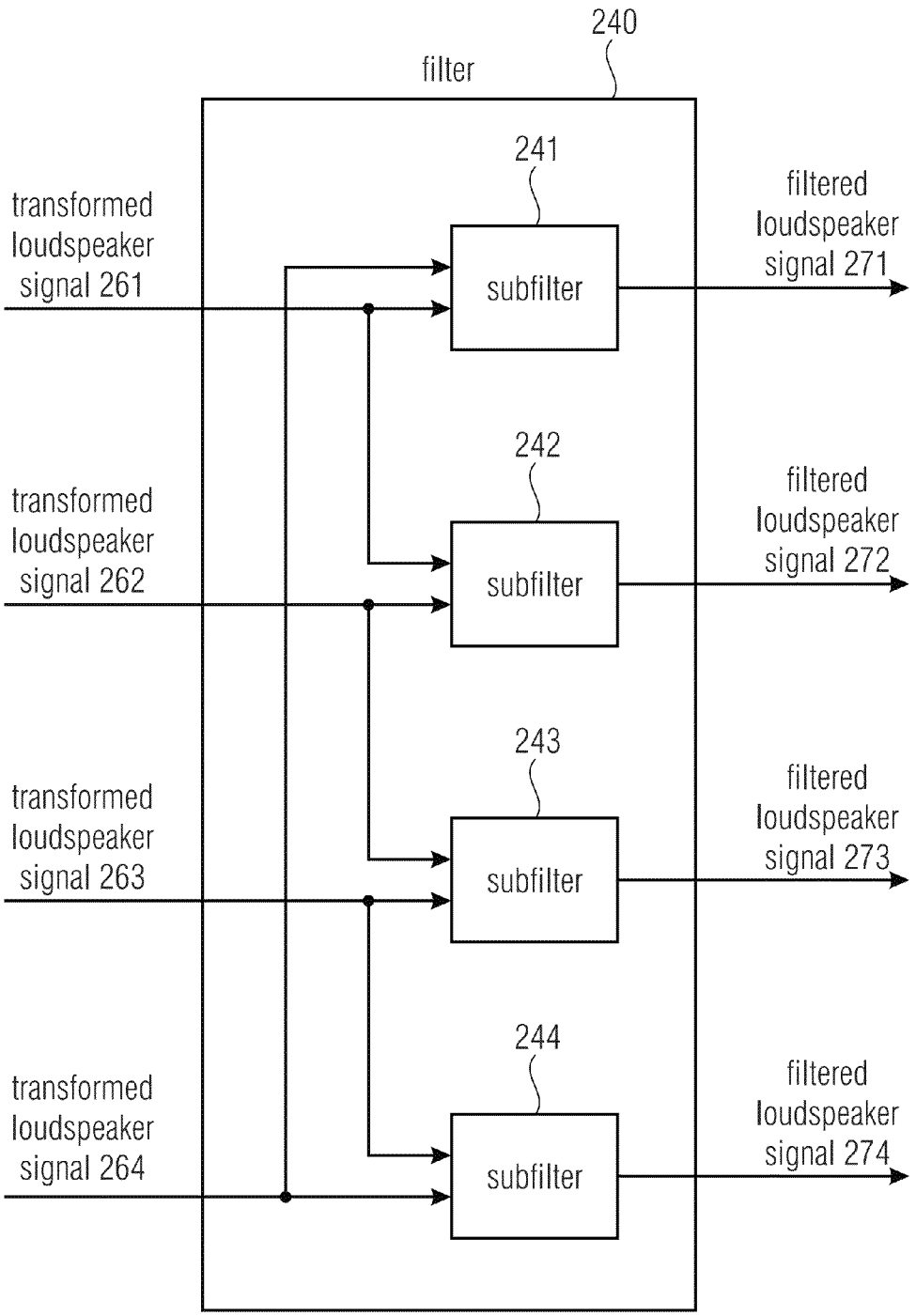
FIG. 2 illustrates a filter for generating filtered loudspeaker signals based on transformed loudspeaker signals according to an embodiment.

FIG. 2 illustrates a filter 240 according to an embodiment. The filter 240 has four subfilters 241, 242, 243, 244.

The first subfilter 241 is arranged to receive the transformed loudspeaker signals 261 and 264. The first subfilter 241 is furthermore adapted to generate the first filtered loudspeaker signal 271 based on the received loudspeaker signals 261 and 264.

The second subfilter 242 is arranged to receive the transformed loudspeaker signals 261 and 262. The second subfilter 242 is furthermore adapted to generate the second filtered loudspeaker signal 272 based on the received loudspeaker signals 261 and 262.

The third subfilter 243 is arranged to receive the transformed loudspeaker signals 262 and 263. The third subfilter 243 is furthermore adapted to generate the third filtered loudspeaker signal 273 based on the received loudspeaker signals 262 and 263.

The fourth subfilter 244 is arranged to receive the transformed loudspeaker signals 263 and 264. The fourth subfilter 244 is furthermore adapted to generate the fourth filtered loudspeaker signal 274 based on the received loudspeaker signals 263 and 264.

Figure 15:
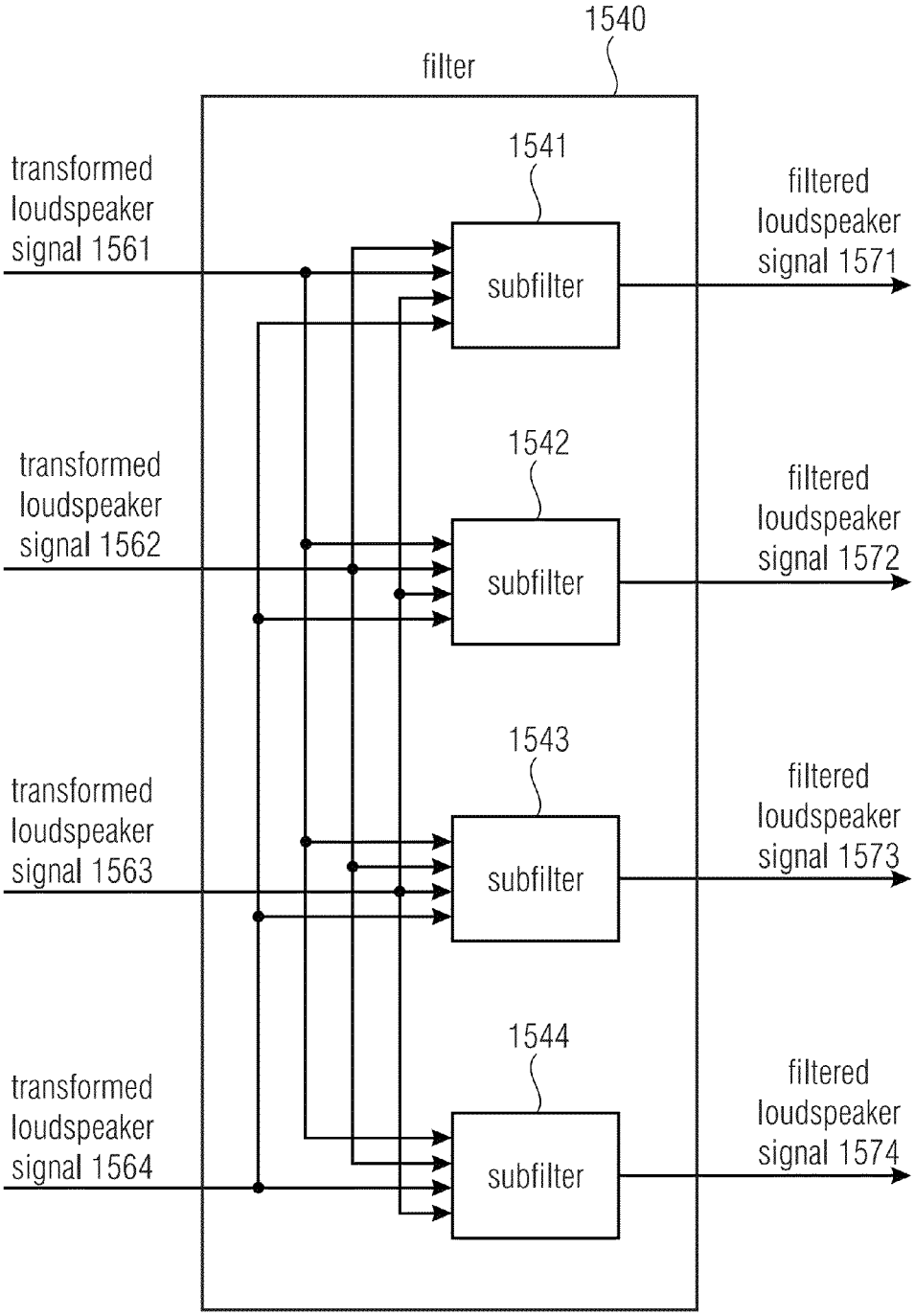
FIG. 15 illustrates a filter for generating filtered loudspeaker signals based on transformed loudspeaker signals according to the state of the art.

The embodiment of FIG. 2 differs from the state of the art illustrated by FIG. 15 in that a subfilter does not have to take all transformed loudspeaker signals 261, 262, 263, 264 into account, when generating a filtered loudspeaker signal. Thus, a simplified filter structure is provided, which is computationally more efficient than the state of the art illustrated by FIG. 15.

Figure 16:
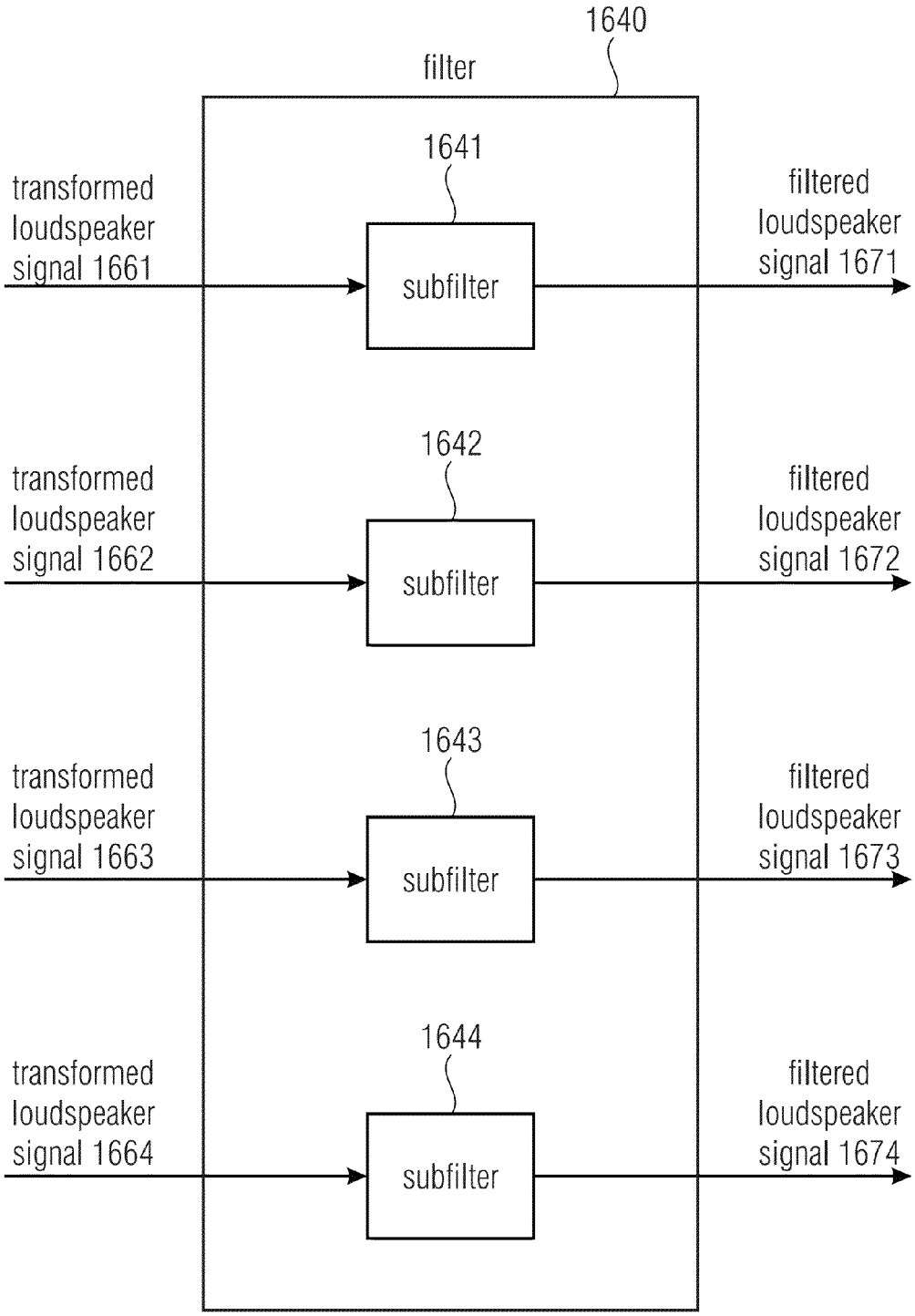
FIG. 16 illustrates another filter for generating filtered loudspeaker signals based on transformed loudspeaker signals according to the state of the art.

Moreover, the embodiment of FIG. 2 differs from the state of the art illustrated by FIG. 16 in that a subfilter takes more than one transformed loudspeaker signal into account, when generating a filtered loudspeaker signal. Thus, a filter structure is provided that provides a sufficient listening room compensation that is sufficient for a complex real-world scenario.

In FIG. 2, all subfilters of the filter receive the same number of transformed loudspeaker signals, namely 2 transformed loudspeaker signals.

Figure 3:
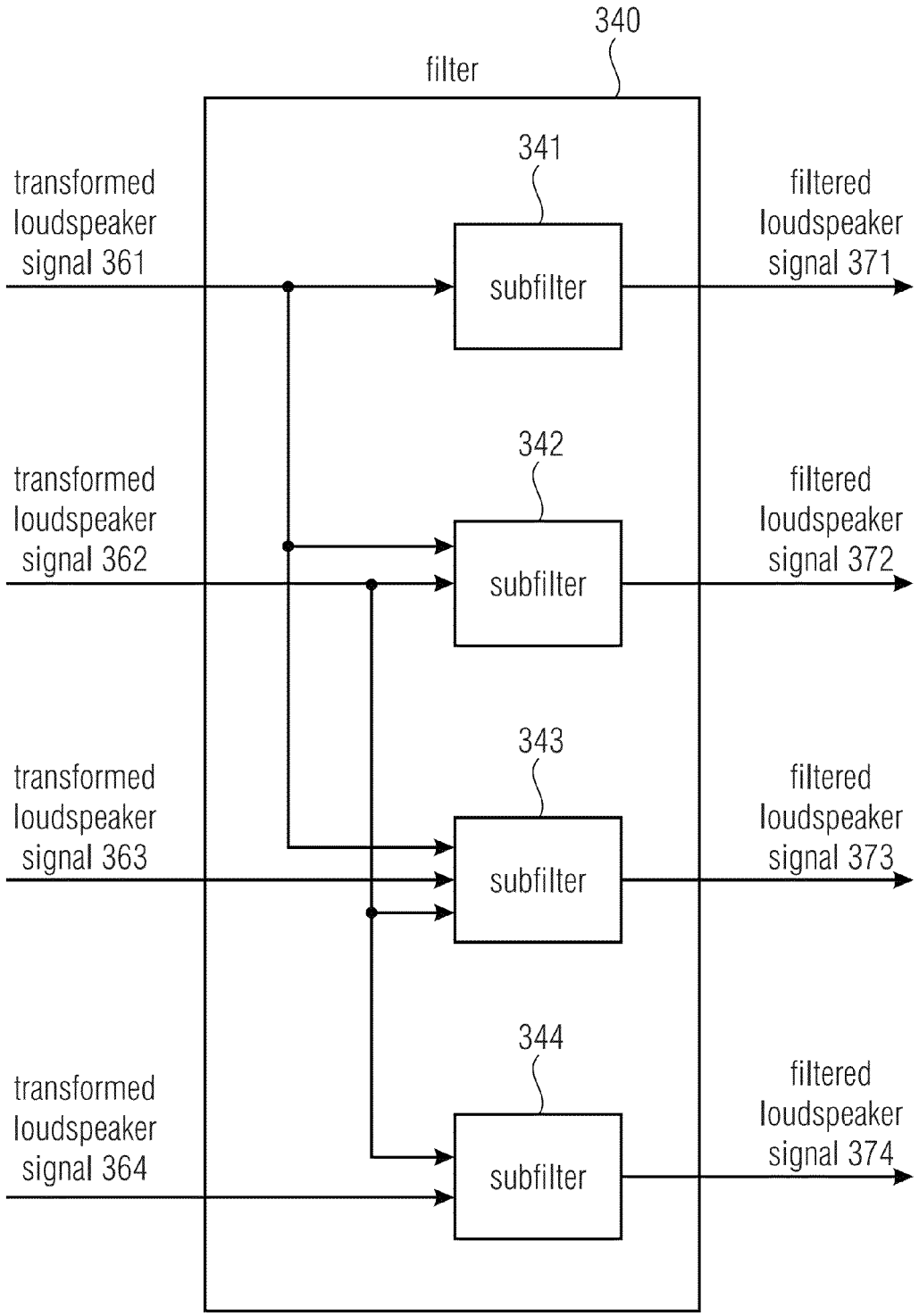
FIG. 3 illustrates a filter for generating filtered loudspeaker signals based on transformed loudspeaker signals according to another embodiment.

FIG. 3 illustrates a filter 340 according to another embodiment. Again, for illustrative purposes, the filter 340 has four subfilters 341, 342, 343, 344.

The first subfilter 341 is arranged to receive the transformed loudspeaker signal 361. The first subfilter 341 is furthermore adapted to generate the first filtered loudspeaker signal 371 only based on the received loudspeaker signal 361.

The second subfilter 342 is arranged to receive the transformed loudspeaker signals 361 and 362. The second subfilter 342 is furthermore adapted to generate the second filtered loudspeaker signal 372 based on the received loudspeaker signals 361 and 362.

The third subfilter 343 is arranged to receive the transformed loudspeaker signals 361, 362 and 363. The third subfilter 343 is furthermore adapted to generate the third filtered loudspeaker signal 373 based on the received loudspeaker signals 361, 362 and 363.

The fourth subfilter 344 is arranged to receive the transformed loudspeaker signals 362 and 364. The fourth subfilter 344 is furthermore adapted to generate the fourth filtered loudspeaker signal 374 based on the received loudspeaker signals 362 and 364.

Again, the embodiment of FIG. 3 differs from the state of the art illustrated by FIG. 15 in that a subfilter does not have to take all transformed loudspeaker signals 361, 362, 363, 364 into account, when generating a filtered loudspeaker signal. Thus, a simplified filter structure is provided, which is computationally more efficient than the state of the art illustrated by FIG. 15.

Moreover, the embodiment of FIG. 3 differs from the state of the art illustrated by FIG. 16 in that at least one of the subfilters takes more than one transformed loudspeaker signal into account, when generating a filtered loudspeaker signal. Thus, a filter structure is provided that provides a sufficient listening room compensation for a real-world scenario.

Figure 4:
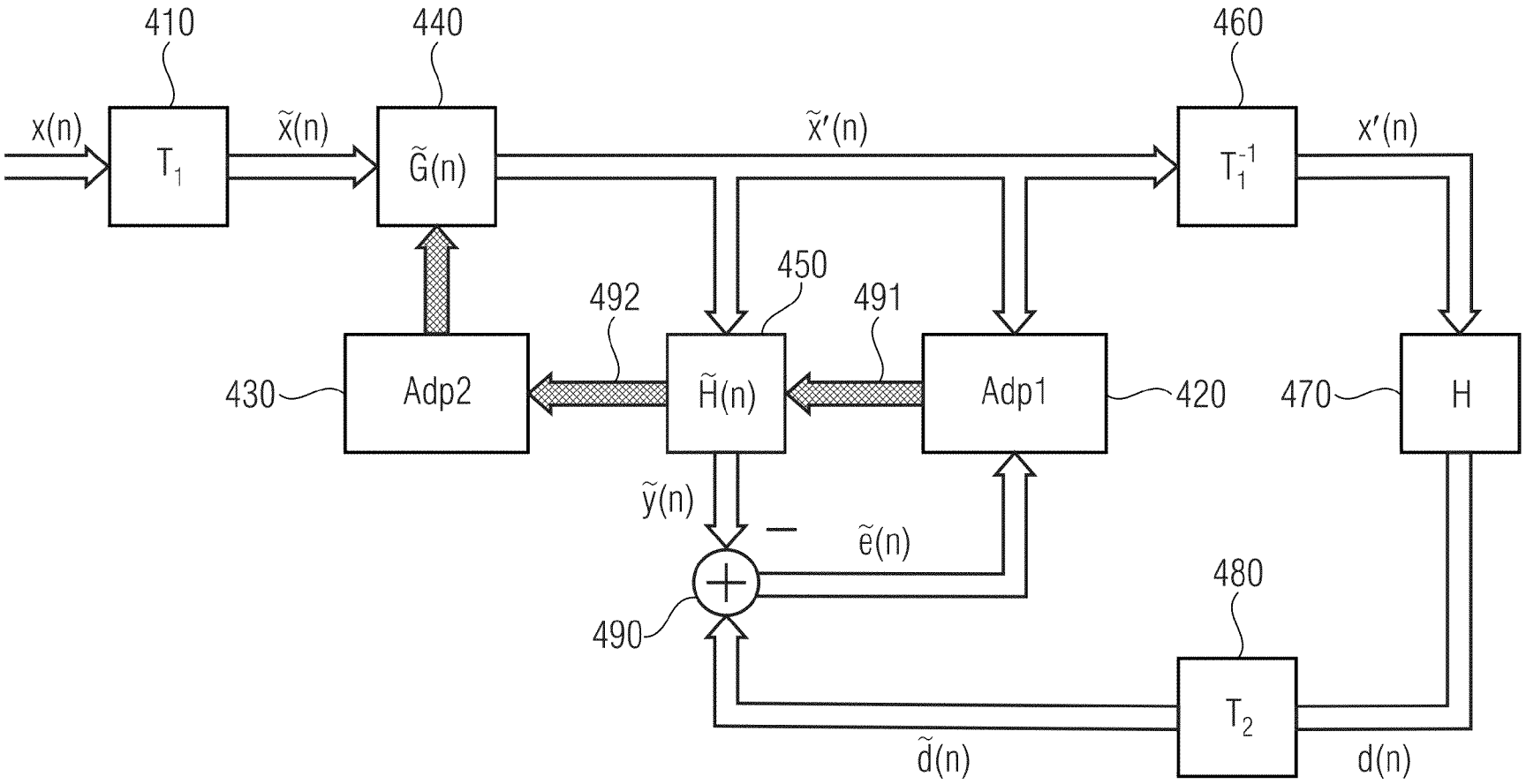
FIG. 4 illustrates an apparatus for listening room equalization according to a further embodiment.

FIG. 4 illustrates an apparatus according to an embodiment. The apparatus of FIG. 4 comprises a first transform unit 410 ("$T_1$"), a system identification adaptation unit 420 ("Adp1"), a filter adaptation unit 430 ("Adp2") and a filter 440 ("$\tilde{G}(n)$"). The first transform unit 410 may correspond to the transform unit 110, the system identification adaptation unit 420 may correspond to the system identification adaptation unit 120, the filter adaptation unit 430 may correspond to the filter adaptation unit 130, and the filter 440 may correspond to the filter 140 of FIG. 1, respectively.

Moreover, FIG. 4 depicts a loudspeaker-enclosure-microphone system estimator 450 (also referred to as "LEMS identification"), an inverse transform unit 460 ("$T_1^{-1}$"), a loudspeaker-enclosure-microphone system 470, a second transform unit 480 ("$T_2$") and an error determiner 490.

At least two loudspeaker input signals x(n) are fed into the first transform unit 410. The first transform unit transforms the at least two loudspeaker input signals x(n) from a time domain to a wave domain to obtain a plurality of transformed loudspeaker signals $\tilde{x}(n)$.

The filter 440, which may comprise a plurality of subfilters, filters the received transformed loudspeaker signals $\tilde{x}(n)$ to obtain a plurality of filtered loudspeaker signals $\tilde{x}'(n)$.

The filtered loudspeaker signals are then transformed back to the time domain by the inverse transform unit 460 and are fed into a plurality of loudspeakers (not shown) of the loudspeaker-enclosure-microphone system 470. A plurality of microphones (not shown) of the loudspeaker-enclosure-microphone system 470 record a plurality of microphone signals as recorded microphone signals d(n).

The plurality of recorded microphone signals d(n) is then transformed by the second transform unit 480 from the time domain to the wave domain to obtain transformed microphone signals $\tilde{d}(n)$. The transformed microphone signals $\tilde{d}(n)$ are then fed into the error determiner 490.

Furthermore, FIG. 4 illustrates that the filtered loudspeaker signals $\tilde{x}'(n)$ are not only fed into the inverse transform unit 460, but also into the loudspeaker-enclosure-microphone system estimator 450. The loudspeaker-enclosure-microphone system estimator 450 comprises a first loudspeaker-enclosure-microphone system identification. Furthermore, the loudspeaker-enclosure-microphone system estimator 450 is adapted to applies the first loudspeaker-enclosure-microphone system identification on the filtered loudspeaker signal to obtain estimated microphone signals $\tilde{y}(n)$. If the first loudspeaker-enclosure-microphone system identification correctly identifies the current state of the real (physical) loudspeaker-enclosure-microphone system 470, the estimated microphone signals $\tilde{y}(n)$ that are fed into the error determiner 490 would be equal to the (real) transformed microphone signals $\tilde{d}(n)$.

The error determiner 490 determines the error $\tilde{e}(n)$ between the (real) transformed microphone signals $\tilde{d}(n)$ and the estimated microphone signals $\tilde{y}(n)$ and feeds the determined error $\tilde{e}(n)$ into the system identification adaptation unit 420.

The system identification adaptation unit 420 adapts the first loudspeaker-enclosure-microphone system identification based on the determined error $\tilde{e}(n)$ to obtain a second loudspeaker-enclosure-microphone system identification. Arrows 491 and 492 indicate, that the second loudspeaker-enclosure-microphone system identification is available for the loudspeaker-enclosure-microphone system estimator 450 and for the filter adaptation unit 430, respectively.

The filter adaptation unit 430 then adapts the filter based on the second loudspeaker-enclosure-microphone system identification.

The described adaptation process is then repeated by conducting another adaptation cycle based on further samples of the plurality of loudspeaker input signals. The loudspeaker-enclosure-microphone system estimator 450 will accordingly apply the second loudspeaker-enclosure-microphone system identification on the filtered loudspeaker signals in the following adaptation cycle.

In the following, all wave-domain quantities will be denoted with a tilde ().

In FIG. 4, vector x(n), which may represent a plurality of loudspeaker input signals that have been determined under free-field conditions, can be decomposed into $$x(n)=((x_0^T(n),x_1^T(n),\ldots,x_{N_L-1}^T(n))^T,$$

$$x_\lambda(n)=x_\lambda(nL_F-L_X+1),x_\lambda(nL_F-L_X+2),\ldots,x_\lambda(nL_F))^T, \quad (1)$$

with a plurality of time samples $x_\lambda(k)$ at time instant k of the loudspeaker signals indexed by $\lambda=0, 1, \ldots, N_{L-1}$ forming the partitions $x_\lambda(n)$ of x(n). Furthermore, $k=nL_F$ is the current time instant, $L_F$ is the frame shift of the system, $N_L$ is the number of loudspeakers, and $L_X$ is chosen so that all matrix-vector-multiplications are consistent. All other signal vectors may be structured in the same way, but exhibit different partition indices and lengths.

Transform unit $T_1$ may determine $N_L$ wave field components according to:

$$\tilde{x}(n)=T_1x(n), \quad (2)$$

which can be decomposed into $N_L$ partitions, indexed by l. The wave field components in $\tilde{x}(n)$ describe the wave field excited by the loudspeakers as it would appear at the microphone array in the free-field case.

The filter $\tilde{G}(n)$, represents a restricted MIMO structure, from which we obtain the filtered (wave-domain) loudspeaker signals are obtained:

$$\tilde{x}'(n)=\tilde{G}(n)\tilde{x}(n), \quad (3)$$

which can be decomposed into $N_L$ partitions, indexed by l'.

Then, $\tilde{x}'(n)$ is transformed back to the domain of the original loudspeaker signals by using $$x'(n)=T_1^{-1}\tilde{x}'(n), \quad (4)$$

before they are fed to the (real) loudspeaker-enclosure-microphone system denoted by H. Multiple (recorded) microphone signals d(n) are obtained. This may be expressed as in formula 5:

$$d(n)=Hx'(n), \quad (5)$$

wherein the $N_M$ microphone signals are indexed by μ. The second transform unit 480 transforms the microphone signals back into the wave domain. The measured wave field may be expressed as in formula 6:

$$\tilde{d}(n)=T_2d(n) \quad (6)$$

in terms of the same class of fundamental solutions of the wave equation as used for the components of $\tilde{x}(n)$. There we have $N_M$ partitions indexed by m, as we have for $\tilde{e}(n)$ and $\tilde{y}(n)$.

$\tilde{H}(n)$ represents the current, e.g. the first or the second, loudspeaker-enclosure-microphone system identification as a wave-domain model. Only a restricted subset of all possible couplings between the wave field components in $\tilde{x}(n)$ and $\tilde{d}(n)$ are modeled by the first and the second loudspeaker-enclosure-microphone system identification.

As already mentioned above, this model (the current, e.g. first or second, loudspeaker-enclosure-microphone system identification) is iteratively adapted by the adaptation algorithm (Adp1), by observing the error $\tilde{e}(n)=\tilde{d}(n)-\tilde{y}(n)$ in the wave-domain. This is done in a way so that $\tilde{y}(n)$ is an estimate for $\tilde{d}(n)$ and, consequently, $\tilde{H}(n)$ is an approximated wave-domain estimate of H(n).

The coefficients determined by the system identification adaptation unit 420 may be used by the filter adaptation unit 430, where the prefilter coefficients of the filter are determined. Multiple possibilities exist to determine the prefilter coefficients, see [8], [10], [11].

In the following, the wave-domain representation of the transformed loudspeaker signals 161, . . . , 16*q* is described.

Conventional models for loudspeaker-enclosure-microphone systems (LEMSs) describe the impulse responses between all loudspeakers and all microphones of a LEMS. The microphone signals may describe the sound pressure measured at the microphone positions. When considering multiple microphones it is possible to describe the sound pressure at all microphone positions simultaneously using a superposition of fundamental solutions of the wave equation. Examples of those basis functions are plane waves, cylindrical harmonics, spherical harmonics, see [16], or the free-field Green's function with respect to the loudspeaker positions.

Figure 5:
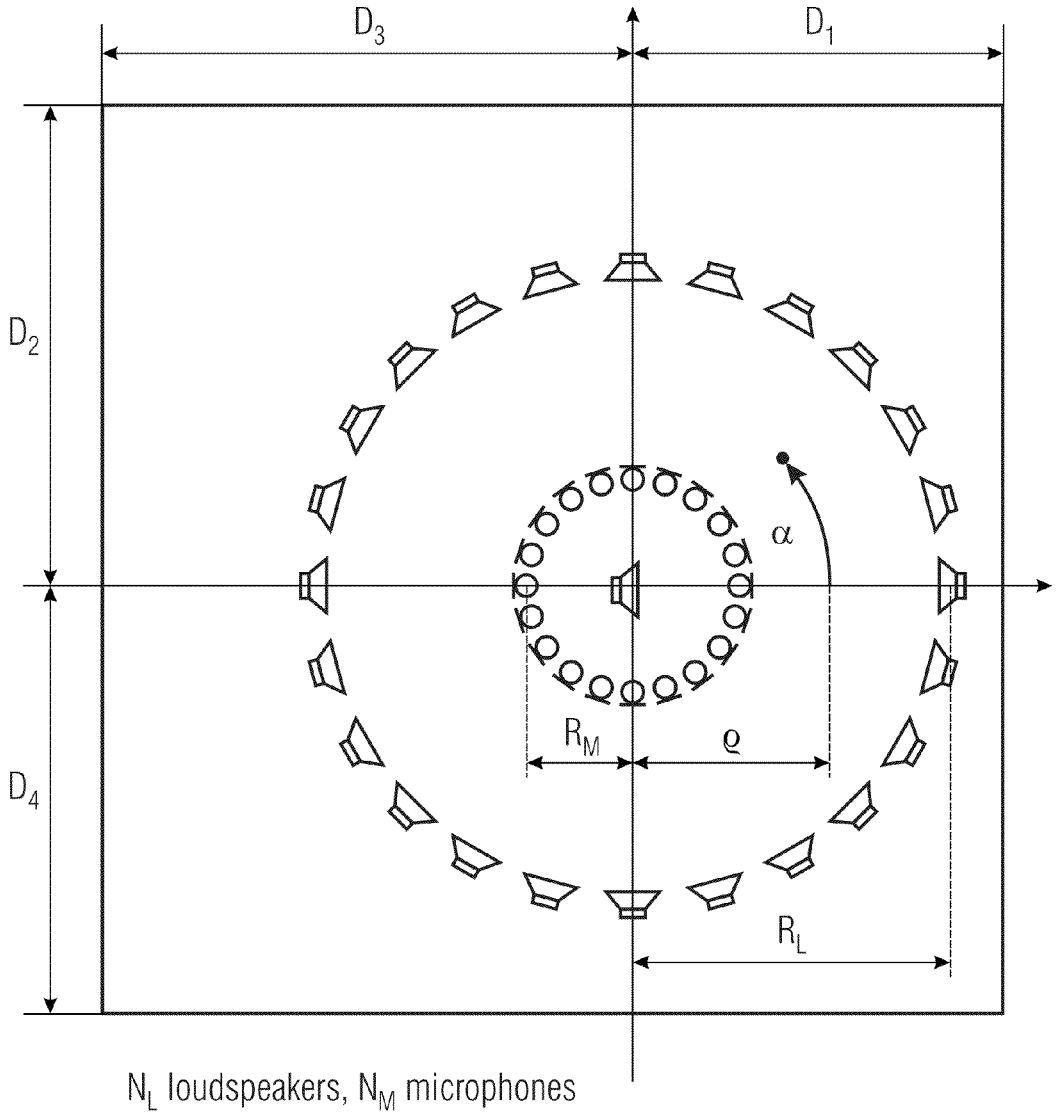
FIG. 5 illustrates a loudspeaker and microphone setup in the LEMS.

FIG. 5 illustrates a plurality of loudspeakers and a plurality of microphones in a circular array setup.

In particular, FIG. 5 illustrates two concentric uniform circular arrays, e.g. a loudspeaker array enclosing a microphone array with a smaller radius. For this planar array setup, the so-called circular harmonics, as described in [6] are used as basis function for the signal representations. This approach is similar to

[3] T. Betlehem and T. D. Abhayapala, "Theory and design of sound field reproduction in reverberant rooms", J. Acoust. Soc. Am., vol. 117, no. 4, pp. 2100-2111, April 2005.

but instead of a perfect steady state equalization it is aimed for a computationally efficient adaptive equalization. For a circular array setup, circular harmonics may be used to describe a wave field in two dimensions. The spectrum of the sound pressure $P(\alpha, Q, j\omega)$ at any point $\vec{x}=(\alpha, Q)^T$ is then given by a sum of circular harmonics.

For a circular array setup, circular harmonics may be used to describe a wave field in two dimensions:

$$P(\alpha, \varrho, j\omega) = \sum_{m=-\infty}^{\infty} \left(\tilde{P}_m^{(1)}(j\omega)\mathcal{H}_m^{(1)}\left(\frac{\omega}{c}\varrho\right) + \tilde{P}_m^{(2)}(j\omega)\mathcal{H}_m^{(2)}\left(\frac{\omega}{c}\varrho\right)\right)e^{jm\alpha} \tag{7}$$

where $P(\alpha, Q, j\omega)$ is the sound pressure at position $\vec{x}=(\alpha, Q)^T$, and where $H_m^{(1)}$ and $H_m^{(2)}$ are Hankel functions of the first and second kind and order m, respectively. The angular frequency is denoted by ω, c is the speed of sound, and j is used as the imaginary unit. The quantities $\tilde{P}_m^{(1)}(j\omega)$ and $\tilde{P}^{(2)}(j\omega)$ may be interpreted as the spectra of incoming and outgoing waves with respect to the origin.

An according wave-domain representation of the microphone signals describes the values of $\tilde{P}_m^{(1)}(j\omega)$ and $\tilde{P}_m^{(2)}(j\omega)$ for different orders m instead of the sound pressure $P(\alpha, Q, j\omega)$ at the individual microphone positions.

In the free-field case, the wave field which would be ideally excited by the loudspeakers. An according description of the loudspeaker signals will be denoted as free-field description, where the index l is used instead of m.

Desirable properties of a LEMS modeled in a wave-domain, may, for example, be found in [14] and [16].

In the following, loudspeaker-enclosure-microphone system identifications are described for the time domain as well as for the wave domain. Again, all wave-domain quantities will be denoted with a tilde. It should be noted that the first and second loudspeaker-enclosure-microphone system identifications that are used by the loudspeaker-enclosure-microphone system estimator 450 of FIG. 4 and that are adapted by the system identification adaptation unit 420 are LEMS identifications in the wave domain.

Considering the microphone signals $$d(n)=(d_0^T(n), d_1^T(n), \ldots, d_{N_M-1}^T(n))^T, \tag{8}$$

$$d_\mu(n)=(d_\mu(nL_F-L_D+1), d_\mu(nL_F-L_D+2), \ldots, d_\mu(nL_F))^T, \tag{9}$$

obtained according to formula 5, the matrix H is structured such that $$d_\mu(k) = \sum_{\lambda=0}^{N_L-1} \sum_{\kappa=0}^{L_H-1} x'_\lambda(k-\kappa)h_{\mu,\lambda}(\kappa). \tag{10}$$

wherein the resulting length of $d_{\mu(n)}$ is given by $L_D=L'_X-L_H+1$, wherein $L'_X$ is the length of the partitions of x'(n) and wherein $L_H$ is the length of the time-discrete impulse response $h_{\mu,\lambda}(k)$ from loudspeaker λ to microphone μ.

In this case, the structure of H is given by $$H = \begin{pmatrix} H_{0,0} & H_{0,1} & \ldots & H_{0,N_L-1} \\ H_{1,0} & H_{1,1} & \ldots & H_{1,N_L-1} \\ \vdots & \vdots & \ddots & \vdots \\ H_{N_M-1,1} & H_{N_M-1,2} & \ldots & H_{N_M-1,N_L-1} \end{pmatrix} \tag{11}$$

which itself comprises Sylvester matrices $$H_{\mu,\lambda} = \begin{pmatrix} h_{\mu,\lambda}(L_H-1) & h_{\mu,\lambda}(L_H-2) & \ldots & h_{\mu,\lambda}(0) & 0 & \ldots & 0 \\ 0 & h_{\mu,\lambda}(L_H-1) & \ldots & h_{\mu,\lambda}(1) & h_{\mu,\lambda}(0) & \ldots & 0 \\ \vdots & \vdots & \ddots & \vdots & \vdots & \ddots & \vdots \\ 0 & 0 & \ldots & 0 & h_{\mu,\lambda}(L_H-1) & \ldots & h_{\mu,\lambda}(0) \end{pmatrix}. \tag{12}$$

When we allow all elements $H_{\mu,\lambda}$ to have nonzero entries, we speak of an unrestricted MIMO structure. An LEMS is in general such an unrestricted MIMO structure. However, for the modeling of this system, we use a restricted MIMO structure. To this end, for the LEMS identification $\tilde{H}$ $$\tilde{H} = \begin{pmatrix} \tilde{H}_{0,0} & \tilde{H}_{0,1} & \dots & \tilde{H}_{0,N_L-1} \\ \tilde{H}_{1,0} & \tilde{H}_{1,1} & \dots & \tilde{H}_{1,N_L-1} \\ \vdots & \vdots & \ddots & \vdots \\ \tilde{H}_{N_M-1,0} & \tilde{H}_{N_M-1,1} & \dots & \tilde{H}_{N_M-1,N_L-1} \end{pmatrix}, \quad (13)$$

we necessitate certain elements $\tilde{H}_{m,l'}$ to have only zero-valued entries, while the others are structured similarly to $H_{\mu,\lambda}$.

Reference is now made to the first transform unit 410, to the inverse transform unit 460 and to the second transform unit 480 of FIG. 4.

Transform $T_1$ of the first transform unit 410 transforms the loudspeaker input signals such that transformed loudspeaker signals are obtained. This transform may be realized by an unrestricted MIMO structure of FIR filters projecting each loudspeaker signal onto an arbitrary number of wave field components in the free-field description. Transform $T_1$ is used to obtain the so-called free-field description $\tilde{x}(n)$, which describes $N_L$ components of the wave field according to formula 7, as it would be ideally excited by the $N_L$ loudspeakers when driven with the loudspeaker signals x(n) under free-field conditions. The obtained wave-field components are identified by their mode order as they are related to the array as a whole. Equivalently, the components of the pre-equalized wave-domain loudspeaker signals $\tilde{x}'(n)$ are indexed by their mode order.

The inverse transform $T_1^{-1}$ of transform $T_1$ employed by the inverse transform unit 460 can also be realized by FIR filters, which may constitute a pseudo-inverse or an inverse (if possible) of $T_1$.

Transform $T_2$ of the second transform unit 480 transforms the microphone signals to the wave domain as described above (e.g., to a so-called measured wave field). To obtain the $N_M$ components of the measured wave field in $\tilde{d}(n)$, $T_2$ is applied to the $N_M$ actually measured microphone signals in d(n). Like $T_1$, $T_2$ is chosen so that the components in $\tilde{d}(n)$ are described according to formula 78, with a mode order. For the considered array setup and basis functions, it was shown that the spatial DFT over the loudspeaker and microphone indices may be used for $T_1$ and $T_2$, see [6], rendering the transform of formula 78 from the temporal frequency domain to the time domain unnecessitated. However, these frequency-independent transforms do not correct the frequency responses of the considered signals according to formula 78. This may be acceptable for embodiments of the present invention, as the adaptive filters will implicitly model the differences in the frequency responses and all descriptions remain consistent.

An example of a derivation of $T_1$ and $T_2$ can be found in [14].

In the following, we will refer to the term "prefilter". In this context, reference is made to FIG. 6 which illustrates a filter $\tilde{G}(n)$ 600 according to an embodiment. The filter 600 is adapted to receive three transformed loudspeaker signals 661, 662, 663 and filters the transformed loudspeaker signals 661, 662, 663 to obtain three filtered loudspeaker signals 671, 672, 673.

For this, the filter 600 comprises three subfilters 641, 642, 643. The subfilter 641 receives two of the transformed loudspeaker signals, namely the transformed loudspeaker signal 661 and transformed loudspeaker signal 662. The subfilter 641 generates only a single filtered loudspeaker signal, namely the filtered loudspeaker signal 671. The subfilter 642 also generates only a single filtered loudspeaker signal 672. Also, the subfilter 643 generates only a single filtered loudspeaker signal 673.

According to an embodiment, each of the subfilters of a filter generates exactly one filtered output signal.

Figure 6:
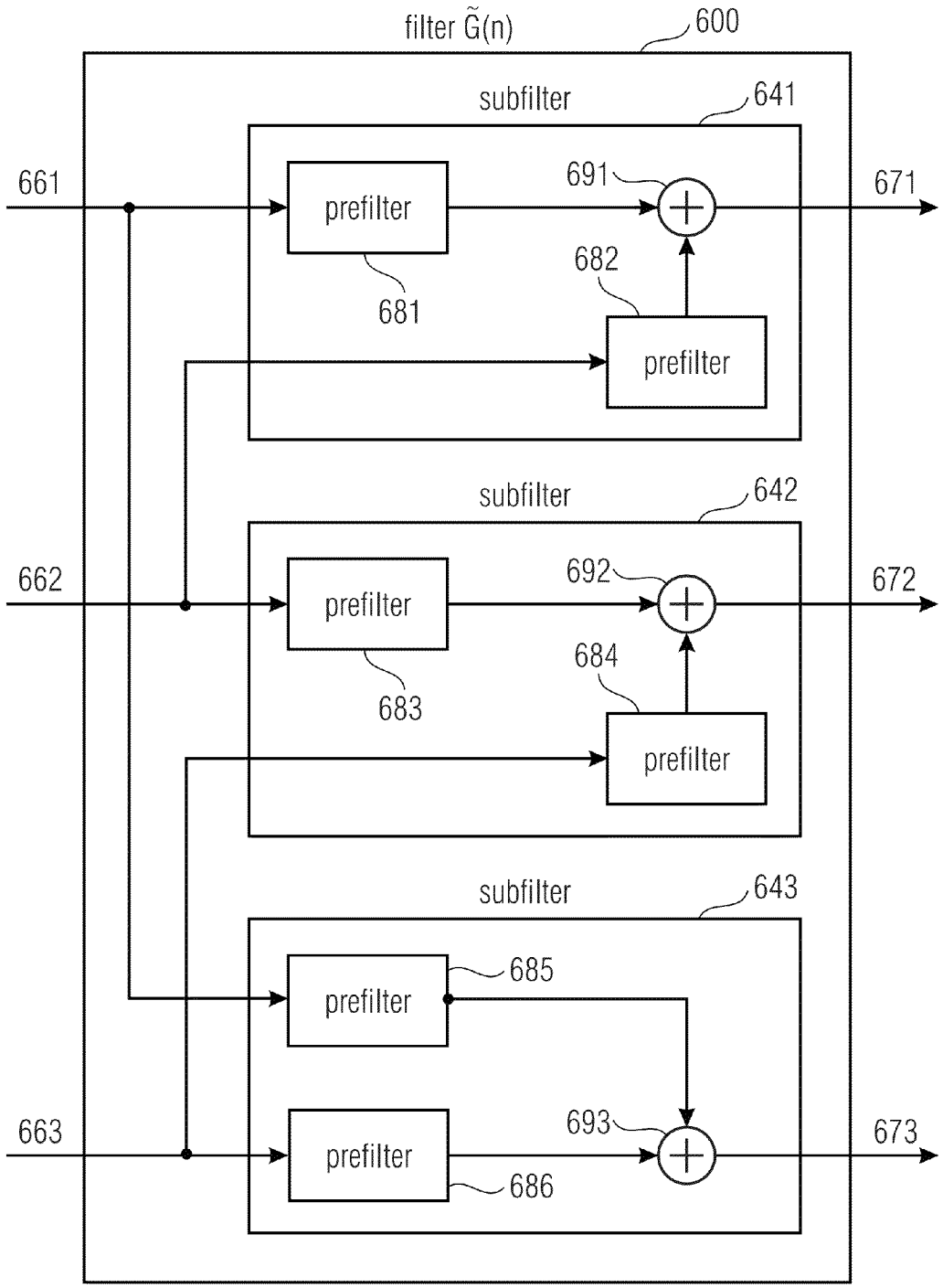
FIG. 6 illustrates a filter for generating filtered loudspeaker signals based on transformed loudspeaker signals according to a further embodiment.

In the embodiment of FIG. 6, the subfilter 641 comprises two prefilters 681 and 682. The prefilter 681 receives and filters only a single transformed loudspeaker signal, namely the transformed loudspeaker signal 661. The prefilter 682 also receives and filters only a single transformed loudspeaker signal, namely the transformed loudspeaker signal 662. All other prefilter of the filter 600 also receive and filter only a single transformed loudspeaker signal.

According to an embodiment, each of the prefilters of a filter does filter exactly one transformed loudspeaker signal.

As illustrated by FIG. 6, and as described above, it should be noted that a prefilter is advantageously a single-input-single-output filter element, wherein a single-input-single-output filter element only receives a single transformed loudspeaker signal at a current time instant or current frame, and potentially the corresponding single transformed loudspeaker signal of one or more preceding time instances or frames, and outputs a single transformed loudspeaker signal at a current time instant or current frame, and potentially the corresponding single transformed loudspeaker signal of one or more preceding time instances or frames.

Now, the relationship between the loudspeaker-enclosure-microphone system identification and the filter for filtering the transformed loudspeaker signals is explained. Moreover, the structure of the LEMS and of the prefilters is explained. To this end, reference is made to FIG. 17*a-c* and FIG. 7*a-d*.

Figure 17A:
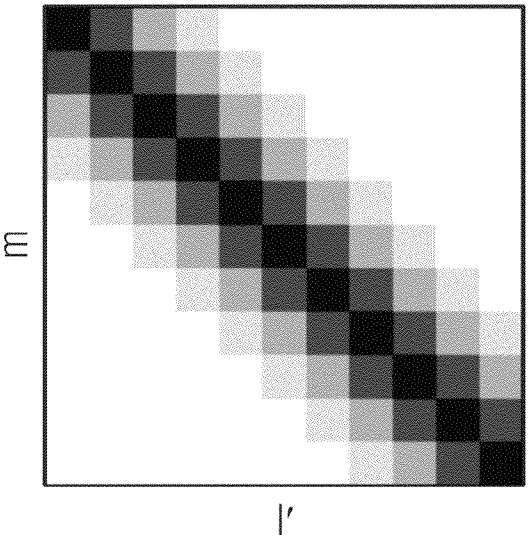
FIG. 17*a-c* are exemplary illustrations of the LEMS model and resulting equalizer weights according to the state of the art.
Figure 17B:
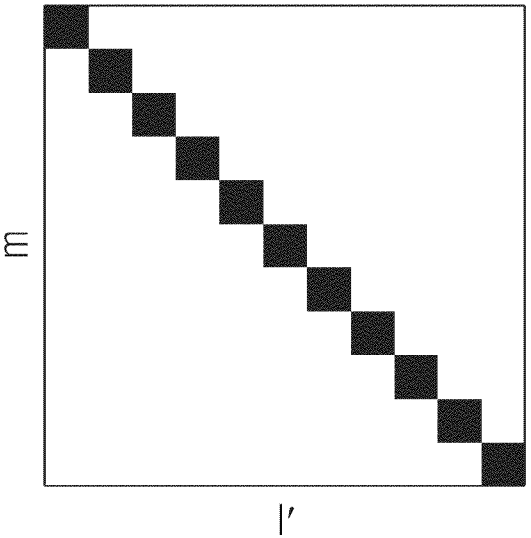
Figure 17C:
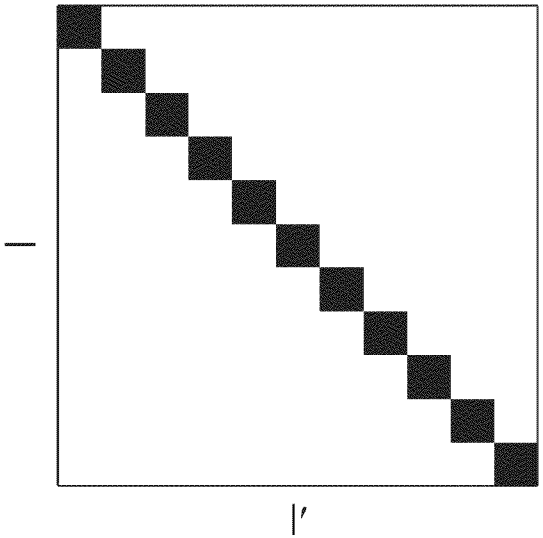

FIG. 17*a-c* are exemplary illustrations of a LEMS model and resulting equalizer weights according to the state of the art. FIG. 17*a* shows the weights of couplings of the wave field components for the true LEMS $T_2HT_1^{-1}$, FIG. 17*b* depicts couplings modeled in $\tilde{H}(n)$ with m=1', and FIG. 17*c* illustrates resulting weights of the equalizers $\tilde{G}(n)$ considering $\tilde{H}(n)$.

Figure 7A:
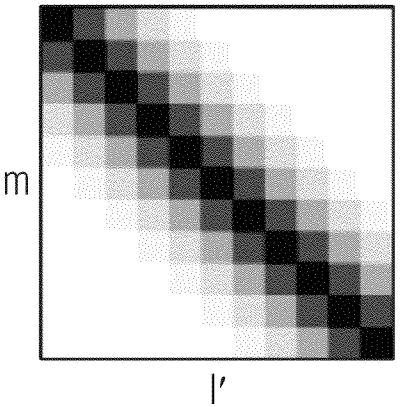
FIG. 7*a-d* are exemplary illustrations of the LEMS model and resulting equalizer weights according to an embodiment.
Figure 7B:
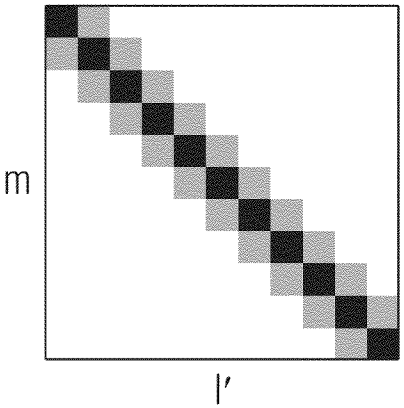
Figure 7C:
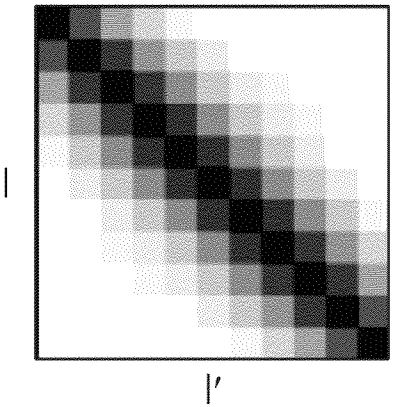
Figure 7D:
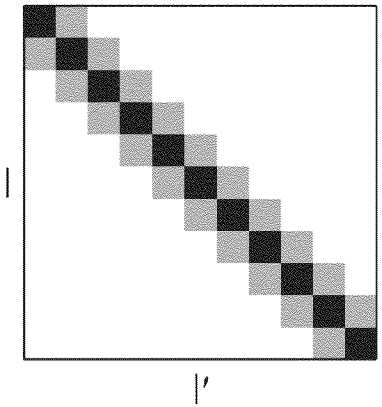

FIG. 7*a-d* are exemplary illustrations of a LEMS model and resulting equalizer weights according to an embodiment of the present invention. FIG. 7*a* shows weights of couplings of the wave field components for the true LEMS $T_2HT_1^{-1}$, FIG. 7*b* depicts couplings modeled in $\tilde{H}(n)$ with $|m-1'|<2$ ($N_H=3$), FIG. 7*c* illustrates resulting weights of the equalizers $\tilde{G}(n)$ considering only $\tilde{H}(n)$, and FIG. 7*d* depicts a used approximation of $\tilde{G}(n)$ with $|1-1'|<2$ ($N_G=3$).

We define a predetermined loudspeaker-enclosure-microphone system identification, e.g. the desired solution, by defining matrix $H^{(O)}$, which has the same structure and dimensions as the matrix H, but wherein $H^{(O)}$ describes the free-field impulse responses between the idealized loudspeakers and microphones.

A wave-domain representation of this matrix may be obtained by $$\tilde{H}^{(O)} = T_2 H^{(O)} T_1^{-1}, \quad (14)$$

and may have the following structure $$\tilde{H}^{(O)} = \begin{pmatrix} \tilde{H}^{(O)}_{0,0} & 0 & \dots & 0 \\ 0 & \tilde{H}^{(O)}_{1,1} & \dots & 0 \\ \vdots & \vdots & \ddots & \vdots \\ 0 & 0 & \dots & \tilde{H}^{(O)}_{N_M-1,N_L-1} \end{pmatrix}, \quad (15)$$

For this example, we assume that $N_M=N_L$. It should be noted that this is a structure similar to the structure illustrated by FIG. 17*b*.

Given a perfect modeling of the LEMS through $\tilde{H}=T_2HT_1^{-1}$, an optimal solution for $\tilde{G}(n)$ would fulfill $$\tilde{H}(n)\tilde{G}(n)=\tilde{H}^{(0)}. \tag{16}$$

assuming $\tilde{H}(n)$ to have the same structure as described in (15), it is clear that $\tilde{G}(n)$ is also structured in the same way. Although an approximate modeling is in general not perfect, $\tilde{G}(n)$ is determined according to $\tilde{H}(n)$ and so the chosen structure of $\tilde{H}(n)$, defines also the structure of an optimal $\tilde{G}(n)$.

The state of the art of LRE comprises a LEMS model, which models only the couplings of wave field components as illustrated in FIG. 17*b* or as described in (15). Consequently, the resulting equalizer structure for this LEMS model according to the state of the art does only describe a coupling of modes of the same order, as shown in FIG. 17*c*, see [15]. The models already used for an Acoustic Echo Cancellation (AEC), have already been generalized, see [14]. An apparatus according to an embodiment allows a more flexible LEMS model than the models of the state of the art for LRE.

There, the couplings of the wave field components with the lowest difference in order are modeled so that per component in the measured wave field $N_H$ components from the free-field description are considered. This is schematically illustrated by FIG. 7*b*.

According to an embodiment, for this model, the resulting weights of the prefilters relating the wave field components in $\tilde{x}(n)$ and $\tilde{x}'(n)$ are illustrated in FIG. 7*c*. There, the entries l=l' are dominant, which can be expected if the entries for m=l' in $\tilde{H}(n)$ are also significantly stronger than the others. This embodiment is based on the concept to again approximate the prefilter structure, as schematically illustrated by FIG. 7*d*, where again $N_G$ components in the free-field description are considered for each wave-domain component of the filtered loudspeaker signals.

In the following, suitable adaptation algorithms are considered. The system identification adaptation unit 420 ("Adp1"), which performs the identification of the LEMS, may be realized employing a generalized frequency-domain adaptive filtering algorithm, see, for example,

[5] Buchner, H.; Benesty, J.; Kellermann, W.: Multichannel Frequency-Domain Adaptive Algorithms with Application to Acoustic Echo Cancellation. In: Benesty, J. (Hrsg.); Huang, Y. (Hrsg.): *Adaptive Signal Processing: Application to Real-World Problems*. Berlin (Springer, 2003), Alternatively, well-known RLS- or LMS-algorithms may be employed as adaptation algorithms, see, for example:

[9] Haykin, S.: *Adaptive filter theory*. Englewood Cliffs, N.J., 2002, or adaptation algorithms involving robust statistics, see, e.g.:

[4] Buchner, H.; Benesty, J.; Gansler, T.; Kellermann, W.: Robust Extended Multidelay Filter and Double-Talk Detector for Acoustic Echo Cancellation. In: *Audio, Speech, and Language Processing, IEEE Transactions on* 14 (2006), Nr. 5, S. 1633-1644.

Independently from the actually used adaptation algorithm, the identification of the LEMS is restricted to a subset of couplings of the wave field components of $x'(n)$ and $\tilde{d}(n)$ which are actually used for modeling the LEMS.

The filter adaptation unit 430 ("Adp2"), which performs the determination of the subfilters (e.g. prefilters) of the filter, can be realized in different ways. For example, it is possible to determine the prefilters by employing a filtered-X-GFDAF-structure, as described in [8].

According to another embodiment, the prefilters directly determined by solving a least squares optimization problem, only considering $\tilde{H}(n)$ and $\tilde{H}^{(0)}$.

According to an embodiment, independently from the used algorithm, only the actually needed prefilters are determined. By this, the computational effort can be significantly reduced and the numerical conditioning of the underlying matrix inversion problem can be improved at the same time with this measure.

The necessitated complexity of the LEMS model and the prefilter structure are dependent on the complexity of the reproduced acoustic scene. This motivates the choice of the prefilter and LEMS model structure, here described by $N_H$ and $N_G$, dependent on the reproduced scene. For the complexity of the scene, the most important property is the number of independently reproduced acoustic sources $N_S$. As this number is usually known when rendering WFS scenes, it can be directly used to determine the used MIMO structures. In the system described here, this would be $$N_G=N_H=N_S. \tag{17}$$

When unknown, $N_S$ may also be estimated based on the observations of $x(n)$.

As has been described above, $\tilde{G}(n)$ is defined by formula 16 as follows:

$$\tilde{H}(n)\tilde{G}(n)=\tilde{H}^{(0)}. \tag{16}$$

This equation can be satisfied, if the requirements of the Multi-Input Multi-Output Theorem (MINT) are satisfied. According to the notation used here, for example, if $N_L=2N_M$, $L_G$ has to be $L_G=L_H-1$ to use this theorem.

As $\tilde{G}(n)$, according to embodiments, has a structure limited as described by formula 19 below, this equation normally cannot be directly solved. However, considering formula 18:

$$\tilde{G}(n)=\begin{pmatrix} \tilde{G}_{0,0}(n) & \tilde{G}_{0,1}(n) & \dots & \tilde{G}_{0,N_L-1}(n) \\ \tilde{G}_{1,0}(n) & \tilde{G}_{1,1,}(n) & \dots & \tilde{G}_{1,N_L-1}(n) \\ \vdots & \vdots & \ddots & \vdots \\ \tilde{G}_{N_L-1,0}(n) & \tilde{G}_{N_L-1,1}(n) & \dots & \tilde{G}_{N_L-1,N_L-1}(n) \end{pmatrix} \tag{18}$$

with $$\tilde{G}_{l',l}=\begin{pmatrix} \tilde{g}_{l',l}(L_G-1) & \tilde{g}_{l',l}(L_G-2) & \dots & \tilde{g}_{l',l}(0) & 0 & \dots & 0 \\ 0 & \tilde{g}_{l',l}(L_G-1) & \dots & \tilde{g}_{l',l}(1) & \tilde{g}_{l',l}(0) & \dots & 0 \\ \vdots & \vdots & \ddots & \vdots & \vdots & \ddots & \vdots \\ 0 & 0 & \dots & 0 & \tilde{g}_{l',l}(L_G-1) & \dots & \tilde{g}_{l',l}(0) \end{pmatrix}, \tag{19}$$

a form of the equation system can be derived which allows a direct solution. For this, the columns of $\tilde{H}(n)$ should be limited by $$\tilde{H}(n)=\tilde{H}(n)B\mathrm{diag}^{N_L}\{(0_{L_G\times(L_H-1)},I_{L_G},0_{L_G\times(L_H-1)})^T\} \tag{20}$$

and by this, formula 21 is obtained:

$$\tilde{H}(n)\tilde{g}_l(n)=\tilde{h}_l^{(0)}\forall l. \tag{21}$$

wherein $$\tilde{g}_l(n)=(\tilde{g}_{0,l}^T(n),\tilde{g}_{1,l}(n),\dots,\tilde{g}_{N_L-1,l}(n))^T \tag{22}$$

$$\tilde{g}_{l',l}(n)=(g_{l',l}(0),g_{l',l}(1),\dots,g_{l',l}(L_G-1))^T \tag{23}$$

By this, $\tilde{h}_l^{(0)}$ can be obtained.

If the requirements for MINT are satisfied, then equation (24) holds:

$$\tilde{g}_l(n)=\tilde{H}^{-1}(n)\tilde{h}_l^{(0)}\forall l. \tag{24}$$

If the requirements for MINT are not satisfied, however, still an approximation in a "squared sense" can be achieved. For this, e(n) as defined by:

$$e(n) = \left(\tilde{H}(n)\tilde{g}_l(n) - \tilde{h}_l^{(0)}\right)^H \left(\tilde{H}(n)\tilde{g}_l(n) - \tilde{h}_l^{(0)}\right) \tag{25}$$

$$= \tilde{g}_l^H(n)\tilde{H}^H(n)\tilde{H}(n)\tilde{g}_l(n) - \tilde{g}_l^H(n)\tilde{H}^H(n)\tilde{h}_l^{(0)} - (\tilde{h}_l^{(0)})^H \tilde{H}(n)\tilde{g}_l(n) + (\tilde{h}_l^{(0)})^H \tilde{h}_l^{(0)},$$

is minimized.

For this, the gradient is set to zero:

$$\check{H}^H(n)\check{H}(n)\check{g}_l(n) = \check{H}^H(n)\check{h}_l^{(0)}. \tag{26}$$

For example, if it is assumed that $N_L < 2N_{\mathcal{M}}$, and $L_G = L_H - 1$, which is an over-determined equation system, then, formula 27 is obtained:

$$\check{g}_l(n) = (\check{H}^H(n)\check{H}(n))^{-1}\check{H}^H(n)\check{h}_l^{(0)}, \tag{27}$$

wherein $(\check{H}^H(n)\check{H}(n))^{-1}\check{H}^H(n)$ represents the pseudo-inverse of $\check{H}(n)$.

According to an embodiment, it is not necessitated to determine all $\check{g}_{l',l}(n)$ to obtain a solution that is sufficient for practical implementations. Consequently, the number of considered columns of $\check{H}(n)$ and by this the dimension of the product $\check{H}^H(n)\check{H}(n)$ can be considerably reduced, which results in huge computational savings when determining the inverse $(\check{H}^H(n)\check{H}(N))^{-1}$.

Such an approximation can either be determined by a direct determination or by a Filtered-X-GFDAF algorithm (GFDAF=Generalized Frequency-Domain Adaptive Filtering) as described in the following. The Filtered-X GFDAF algorithm described there reduces the lines of $\tilde{H}(n)$, which results from considering the reduced structure of $\tilde{H}(n)$ in the wave domain. Such an approximation can reduce the computational-intensive redundancy of such a filtered-X-structure even further (see below).

Figure 8:
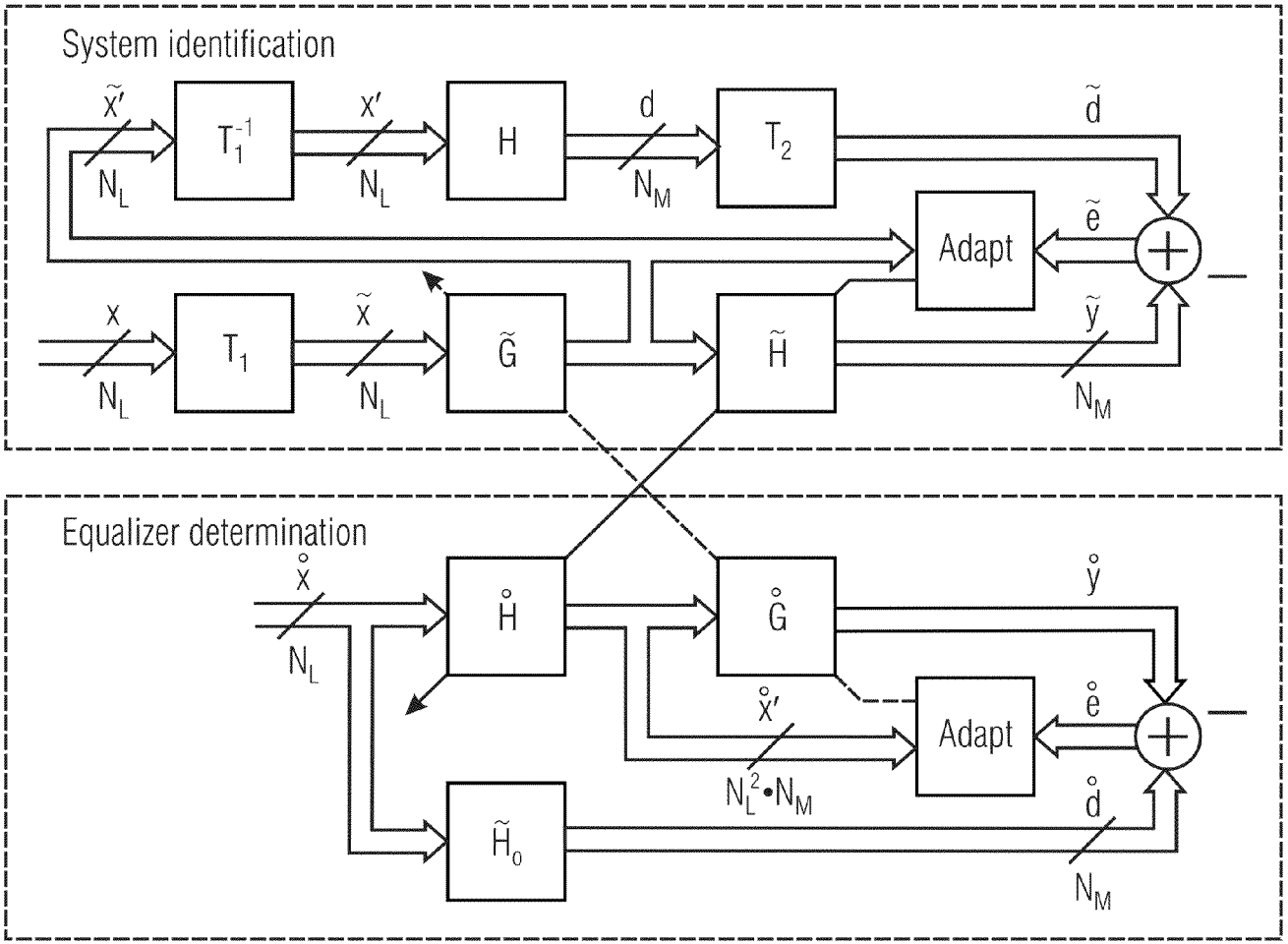
FIG. 8 illustrates an apparatus for listening room equalization according to an embodiment.

FIG. 8 illustrates an apparatus according to a further embodiment. In FIG. 8, $T_1$, $T_2$, $T_1^{-1}$ illustrate transforms to and from the wave domain; H depicts a system response of the LEMS; $\tilde{H}$, $\mathring{H}$ illustrates LEMS identifications; $\tilde{H}_0$ is the desired free-field response; and $\mathring{G}$, $\tilde{G}$ are filters (equalizers). For the purpose of a more convenient illustration, the dependency of the block index n of different quantities is omitted.

The upper part of FIG. 8 is dedicated to the identification of the acoustic MIMO system in the wave domain. The obtained knowledge is then used in the lower part to determine their equalizers accordingly. In contrast to [15], these steps are separated to allow the use of the generalized equalizer structure.

As has been described above, the input signal of the system is given by the loudspeaker signal vector x(n) comprising a block (index by n) of $L_X$ time-domain samples of all $N_L$ loudspeaker signals:

$$x(n) = (x_1(nL_F - L_X + 1), \ldots x_1(nL_F),$$

$$x_2(nL_F - L_X + 1), \ldots x_2(nL_F), \ldots x_{N_L}(nL_F)) \tag{28}$$

where $x_\lambda(k)$ is a time-domain sample of the loudspeaker signal λ at the time instant k and $L_F$ is the frame shift. All considered signal vectors are structured in the same way, but may differ in their lengths and numbers of components.

Transform $T_1$ is used to obtain the so-called free-field representation $\tilde{x}(n) = T_1 x(n)$ and will be explained below together with $T_2$.

The equalizers in $\tilde{G}(n)$ are copies of the filters in $\mathring{G}(n)$ and are used to obtain the equalized loudspeaker signals $\tilde{x}'(n) = \tilde{G}(n)\tilde{x}(n)$ in the wave-domain.

These equalizers are then transformed back and fed to the LEMS H from which we obtain the $N_{\mathcal{M}}$ microphone signals comprise in $d(n) = H\tilde{x}'(n)$ The matrix H is structured so that $$d_\mu(k) = \sum_{\kappa=0}^{L_H - 1} x'_\lambda(k - \kappa) h_{\mu,\lambda}(\kappa), \tag{29}$$

where $h_{\mu,\lambda}(k)$ describes the room impulse response of length $L_H$ from loudspeaker λ to microphone μ. All other considered matrices are of similar structure. To identify the LEMS by $\tilde{H}(n)$ in the wave-domain, we transform the microphone signals to the measured wave field $\tilde{d}(n) = T_2 d(n)$ and determine the wave-domain error $\tilde{e}(n)$ as the difference between $\tilde{d}(n)$ and its estimate $\tilde{y}(n) = \tilde{H}(n)x'(n)$. For the adaptation of $\tilde{H}(n)$, the squared error $\tilde{e}^H(n)\tilde{e}(n)$ is minimized For the determination of the equalizers we use the free-field description of the loudspeaker signals as input $\mathring{x}(n) = \tilde{x}(n)$.

Noise could also be used as input $\mathring{x}(n)$.

[8] S. Goetze, M. Kallinger, A. Mertins, and K. D. Kammeyer, "Multi-channel listening-room compensation using a decoupled filtered-X LMS algorithm", in Proc. Asilomar Conference on Signals, Systems and Computers, October 2008, pp. 811-815.

The signals are filtered by $\mathring{H}(n)$ which comprises the copied coefficients from $\tilde{H}(n)$, although the output vector $\mathring{x}'(n) = \mathring{H}(n)\mathring{x}(n)$ is structured differently: it contains all $N_L^2 \cdot N_{\mathcal{M}}$ possible combinations of filtering the $N_L$ signal components in $\mathring{x}(n)$ with the $N_L \cdot N_{\mathcal{M}}$ impulse responses contained in $\tilde{H}(n)$. This is necessitated for the multichannel filtered-X generalized frequency domain adaptive filtering (GFDAF) as described in [8] for conventional (not wave-domain) equalization. The $N_L^2$ filters in $\mathring{G}(n)$ are then adapted so that $\mathring{y}(n) = \mathring{G}(n)\mathring{x}'(n)$ approximates the desired signal $\mathring{d}(n) = \tilde{H}_0 \mathring{x}(n)$ which is obtained by filtering $\mathring{x}(n)$ with the free-field response $\tilde{H}_0$ in the wave-domain. The error $\mathring{e}(n) = \mathring{y}(n)\mathring{d}(n)$ is squared and $\mathring{e}^H(n)\mathring{e}(n)$ is used as an optimization criterion for adapting $\mathring{G}(n)$.

Regarding adaptation algorithms, the GFDAF algorithm, as for example described for AEC in

[6] M. Schneider and W. Kellermann, "A wave-domain model for acoustic MIMO systems with reduced complexity", in Proc. Joint Workshop on Hands-free Speech Communication and Microphone Arrays (HSCMA), Edinburgh, UK, May 2011 has been used for the system identification in the wave-domain, e.g. the adaptation of $\tilde{H}(n)$. For the adaptation of $\mathring{G}(n)$, the filtered-X GFDAF was used with $\mathring{x}'(n)$ as filter output according to [8].

In the following, reference will be made to $\mathring{H}^{(0)}$ which has the same meaning as $\tilde{H}^{(0)}$. $\mathring{H}^{(0)}$ is in general independent from n.

Figure 9:
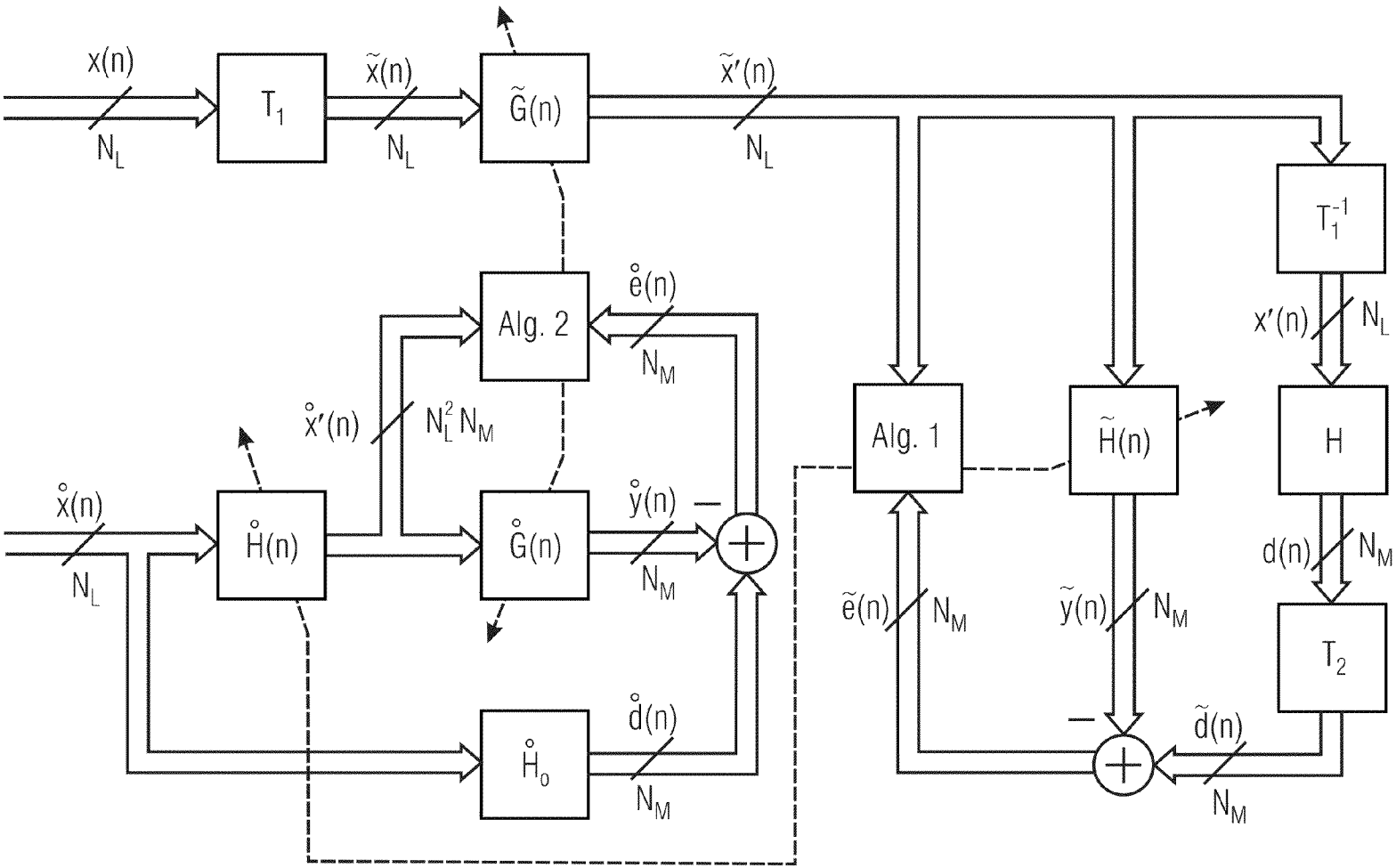
FIG. 9 illustrates an apparatus for listening room equalization according to an embodiment.

FIG. 9 illustrates a block diagram of a system for listening room equalization. For the purpose of system identification, FIG. 9 employs a GFDAF algorithm, e.g. a Filtered-X GFDAF algorithm, which is described below and which is formulated for determining the prefilters.

In FIG. 9, $T_1$, $T_2$ are transformations to the wave domain. $T_1^{-1}$ are transformations from the wave domain to the time domain; $\mathring{G}(n)$, $\tilde{G}(n)$ are prefilters, H(n) is a LEMS; $\tilde{H}(n)$, $\mathring{H}(n)$ is a LEMS-identification (a LEMS model) and $\mathring{H}_0(n)$ is a predetermined (desired) impulse response. "Alg.1" is an algorithm for system identification by means of $\tilde{H}(n)$, while "Alg.2" is an algorithm for determining the prefilter coefficients in $\overset{0}{G}(n)$.

Now, the matrix notification employed for describing the MIMO-FIR-filter is explained with respect to the loudspeaker signals and the microphone signals. The loudspeaker signals are represented by vector x'(n) in FIG. 9, wherein the vector can be partitioned in $N_L$ partitions:

$$x'(n)=((x'_0(n))^T,(x'_1(n))^T,\ldots,(x'_{N_L-1}(n))^T)^T \tag{30}$$

Each partition:

$$x'_\lambda(n)=(x_\lambda'(nL_F-L_X+1),x_\lambda'(nL_F-L_X+2),\ldots,x_\lambda'(nL_F))^T \tag{31}$$

comprises $L_X'$ time sample values $x_\lambda'(k)$ of the loudspeaker signal λ at point in time k. The frame-shift $L_F$ will be determined later by employing the used adaptation algorithm, while the lengths of the considered impulse responses and the value of $L_X'$ are also taken into account. The microphone signals $$d(n)=(d_0^T(n),d_1^T(n),\ldots,d_{N_M-1}^T(n))^T$$

$$d_\mu(n)=(d_\mu(nL_F-L_D+1),d_\mu(nL_F-L_D+2),\ldots,d_\mu(nL_F))^T \tag{32}$$

have a similar structure as the loudspeaker signals, while each of the $L_D$ time sample values $d_\mu(k)$ of the microphone signals which are indexed by μ can be considered together.

To describe the filtering of the LEMS, a matrix H is defined, such that $$d_\mu(k)=\sum_{\lambda=0}^{N_L-1}\sum_{\kappa=0}^{L_H-1}x'_\lambda(k-\kappa)h_{\mu,\lambda}(\kappa) \tag{33}$$

The length is $L_D=L_X-L_H+1$, wherein $L_H$ is the length of the time-discrete impulse response $h_{\mu,\lambda}(k)$ from a loudspeaker λ to a microphone μ. The matrix H, which represents this mapping for all loudspeaker-microphone-pairs, is defined according to:

$$d(n)=Hx'(n) \tag{34}$$

and can be decomposed into $N_L \cdot N_M$ separate matrices, which are the matrix elements of the matrix H as defined by formula 35:

$$H=\begin{pmatrix} H_{0,0} & H_{0,1} & \ldots & H_{0,N_L-1} \\ H_{1,0} & H_{1,1} & \ldots & H_{1,N_L-1} \\ \vdots & \vdots & \ddots & \vdots \\ H_{N_M-1,1} & H_{N_M-1,2} & \ldots & H_{N_M-1,N_L-1} \end{pmatrix} \tag{35}$$

Here, each of the matrices is a Sylvester matrix:

$$H_{\mu,\lambda}=\begin{pmatrix} h_{\mu,\lambda}(L_H-1) & h_{\mu,\lambda}(L_H-2) & \ldots & h_{\mu,\lambda}(0) & 0 & \ldots & 0 \\ 0 & h_{\mu,\lambda}(L_H-1) & \ldots & h_{\mu,\lambda}(1) & h_{\mu,\lambda}(0) & \ldots & 0 \\ \vdots & \vdots & \ddots & \vdots & \vdots & \ddots & \vdots \\ 0 & 0 & \ldots & 0 & h_{\mu,\lambda}(L_H-1) & \ldots & h_{\mu,\lambda}(0) \end{pmatrix} \tag{36}$$

The description presented here, is in principle used for all signals and systems, e.g. as those illustrated in FIG. 9, but, however, may have different dimensions.

In FIG. 9, the vector x(n) represents the loudspeaker signals, which have not been pre-equalized. For a correct replay of the desired acoustical scene, the loudspeaker signals are pre-equalized (prefiltered) by the system. Vector x(n), which represents the loudspeaker signals comprises $N_L$ partitions, wherein each partition has $L_X$ time sample values.

The free-field description $\tilde{x}(n)$ comprises $N_L$ partitions of length $\tilde{L}_X$ and is shown in formula 37:

$$\tilde{x}(n)=T_1x(n). \tag{37}$$

It is generated by the transformation $T_1$, as described above. Each partition $\tilde{x}_l(n)$ is indicated by the wave field component index l.

After the pre-equalization, the vector $\tilde{x}'(n)$ is obtained:

$$\tilde{x}'(n)=\tilde{G}(n)\tilde{x}(n) \tag{38}$$

which again has $N_L$ partitions of length $\tilde{L}'_X$. The matrix $$\tilde{G}(n)=\begin{pmatrix} \tilde{G}_{0,0}(n) & \tilde{G}_{0,1}(n) & \ldots & \tilde{G}_{0,N_L-1}(n) \\ \tilde{G}_{1,0}(n) & \tilde{G}_{1,1}(n) & \ldots & \tilde{G}_{1,N_L-1}(n) \\ \vdots & \vdots & \ddots & \vdots \\ \tilde{G}_{N_L-1,0}(n) & \tilde{G}_{N_L-1,1}(n) & \ldots & \tilde{G}_{N_L-1,N_L-1}(n) \end{pmatrix} \tag{39}$$

describes the pre-equalization, wherein each of the submatrices $\tilde{G}_{l',l}(n)$ represents the filtering of the component l in $\tilde{x}(n)$ with respect to component l' in $\tilde{x}'(n)$ and is structured as defined by formula 36.

Each matrix coefficient of the filter matrix $\tilde{G}(n)$ can be regarded as a filter coefficient for a loudspeaker signal pair of one of the transformed loudspeaker signals and one of the filtered loudspeaker signals, as the respective matrix coefficient describes, to what degree the corresponding transformed loudspeaker signal influences the corresponding filtered loudspeaker signal that will be generated.

To replay the loudspeaker signals by employing $\tilde{x}'(n)$, the signal has to be re-transformed to the domain of the loudspeaker input signals (e.g. the time domain):

$$x'(n)=T_1^{-1}\tilde{x}'(n) \tag{40}$$

Here, $T_1^{-1}$ represents the inverse of $T_1$, if such an inverse matrix exists. If this is not the case, a pseudo-inverse can be used, see, for example, [13].

The microphone signals d(n) are obtained from the LEMS, and are then transformed to the wave domain according to equation (43):

$$\tilde{d}(n)=T_2d(n) \tag{41}$$

The transformation $T_2$ of formula 41 describes the measured wavefield (identified wavefield) and has the same base functions as $\tilde{x}(n)$, even though its components are indexed by m.

The LEMS identification in the wave domain (the model for the LEMS) is represented by the matrix:

$$\tilde{H}(n)=\begin{pmatrix} \tilde{H}_{0,0}(n) & \tilde{H}_{0,1}(n) & \ldots & \tilde{H}_{0,N_L-1}(n) \\ \tilde{H}_{1,0}(n) & \tilde{H}_{1,1}(n) & \ldots & \tilde{H}_{1,N_L-1}(n) \\ \vdots & \vdots & \ddots & \vdots \\ \tilde{H}_{N_M-1,0}(n) & \tilde{H}_{N_M-1,1}(n) & \ldots & \tilde{H}_{N_M-1,N_L-1}(n) \end{pmatrix} \tag{42}$$

wherein for certain combinations of m and l, it is assumed that $\tilde{H}_{m,l}(n)=0$. By this, an efficient modelling of the LEMS is achieved, as has already been described above.

The vector $\tilde{y}(n)$ is obtained by:

$$\tilde{y}(n)=\tilde{H}(n)\tilde{x}'(n) \tag{43}$$

Here, $\tilde{y}(n)$ as well as $\tilde{e}(n)$ has the same structure as $\tilde{d}(n)$. As will be described later, the filter coefficients are determined by block "Alg.1" which minimizes the Euclidian measure $\|\tilde{e}(n)\|_2$:

$$\tilde{e}(n)=\tilde{d}(n)-\tilde{y}(n) \tag{44}$$

By this, $\tilde{H}(n)$ identifies the system $T_2HT_1^{-1}$.

The input signal for determining the prefilters is represented by $\overset{\circ}{x}(n)$, which has the same structure as $\tilde{x}(n)$. For this signal, a suitable noise signal can be generated or, as an alternative, $\overset{\circ}{x}(n)=\tilde{x}(n)$ is used.

The desired (predetermined) signal, which is structured as $\tilde{d}(n)$, in the wave domain is obtained by:

$$\overset{\circ}{d}(n)=\tilde{H}^{(0)}(n)\overset{\circ}{x}(n) \tag{45}$$

$\tilde{H}^{(0)}(n)$ represents the desired (predetermined) impulse response of the series connection of the prefilters and the LEMS in the wave domain. If the impulse response of the free field transmission shall be achieved, the following structure results independently of the numbers of loudspeakers and microphones employed:

$$\overset{\circ}{H}^{(0)}=\begin{pmatrix} \overset{\circ}{H}^{(0)}_{0,0} & 0 & \dots & 0 \\ 0 & \overset{\circ}{H}^{(0)}_{1,1} & \dots & 0 \\ \vdots & \vdots & \ddots & \vdots \\ 0 & 0 & \dots & \overset{\circ}{H}^{(0)}_{N_M-1,N_L-1} \end{pmatrix} \tag{46}$$

wherein $N_M=N_L$ is assumed for this example. If $N_M\neq N_L$ the non-squared portion of the matrix is filled with zeros.

The signal $\overset{\circ}{x}(n)$ is also, at the same time, the source for the pre-filtered (filtered-X) input signal $\overset{\circ}{x}'(n)$ for determining the pre-filter coefficients. This signal is obtained by formula 47:

$$\overset{\circ}{x}'(n)=\overset{\circ}{H}(n)\overset{\circ}{x}(n) \tag{47}$$

In contrast to the signals considered above, this signal does not have $N_L$ or $N_M$ components but, instead, has $N_L^2N_M$ components, wherein each component is a combination of the filtering of the component of $\overset{\circ}{x}(n)$ of all inputs and outputs of $\overset{\circ}{H}(n)$. The matrix $\overset{\circ}{H}(n)$ needed for this is defined as by formula 48:

$$\overset{\circ}{H}(n)=\begin{pmatrix} \overset{\circ}{H}_0(n) \\ \overset{\circ}{H}_1(n) \\ \vdots \\ \overset{\circ}{H}_{N_M-1}(n) \end{pmatrix} \tag{48}$$

which has the submatrices $$\overset{\circ}{H}_m(n)=\begin{pmatrix} \tilde{H}_{m,0}(n) & 0 & \dots & 0 \\ \tilde{H}_{m,1}(n) & 0 & \dots & 0 \\ \vdots & \vdots & \ddots & \vdots \\ \tilde{H}_{m,N_L-1}(n) & 0 & \dots & 0 \\ 0 & \tilde{H}_{m,0}(n) & \dots & 0 \\ 0 & \tilde{H}_{m,1}(n) & \dots & 0 \\ \vdots & \vdots & \ddots & \vdots \\ 0 & \tilde{H}_{m,N_L-1}(n) & \dots & 0 \\ \vdots & \vdots & \ddots & \vdots \\ 0 & 0 & \dots & \tilde{H}_{m,0}(n) \\ 0 & 0 & \dots & \tilde{H}_{m,1}(n) \\ \vdots & \vdots & \ddots & \vdots \\ 0 & 0 & \dots & \tilde{H}_{m,N_L-1}(n). \end{pmatrix} \tag{49}$$

For iterative determination, the prefilters are depicted by $\overset{\circ}{G}(n)$, wherein $$\overset{\circ}{G}(n)\overset{\circ}{H}(n)=\tilde{H}(n)\tilde{G}(n) \tag{50}$$

has to be satisfied. By this, for $\overset{\circ}{G}(n)$ the following results:

$$\begin{aligned}\overset{\circ}{G}(n)=B\mathrm{diag}^{N_M}\{&\tilde{G}_{0,0}(n),\tilde{G}_{1,0}(n),\dots,\\ &\tilde{G}_{N_L,0}(n),\dots,\tilde{G}_{0,1}(n),\tilde{G}_{1,1}(n),\dots,\\ &\tilde{G}_{N_L,1}(n),\dots,\tilde{G}_{0,N_L}(n),\tilde{G}_{1,N_L}(n),\dots,\\ &\tilde{G}_{N_L,N_L}(n)\}.\end{aligned} \tag{51}$$

wherein the $B\mathrm{diag}^N\{M\}$-operator generates a matrix with n repetitions of the matrix M on the diagonal.

In the following, system identification by employing the GFDAF-algorithm is described. To this end, the algorithm presented in [5] is described.

For presenting the free-field description in the DFT (Discrete Fourier Transform), we define:

$$\underline{\tilde{X}}_{l'}^{1}(n)=\mathrm{Diag}\{F_{2L_H}\tilde{x}_{l'}^{l}(n)\} \tag{52}$$

wherein the matrix $F_L$ is a DFT matrix of size L×L comprising the components $\tilde{x}_l'(n)$:

$$\tilde{x}'(n)=(\tilde{x}_0^T(n),\tilde{x}_1^T(n),\dots\tilde{x}_{N_L-1}^T(n))^T \tag{53}$$

from this description we obtain $\underline{\tilde{X}}_m(n)$ by horizontally concatenating $\underline{\tilde{X}}'_l(n)$ having indices l for each m, for example $$\underline{\tilde{X}}_0(n)=(\underline{\tilde{X}}_0'(n),\underline{\tilde{X}}_1'(n),\underline{\tilde{X}}_{47}'(n)), \tag{54}$$

when the coupling of the wave field components l'=0, 1, 47 and m=0 are modelled while meeting the requirements of model complexity by the choice of the model's couplings, as described above.

Furthermore, we define the representations of the measured wavefield in the DFT-domain by considering the new partitions of $\tilde{d}(n)$:

$$\tilde{d}(n)=(\tilde{d}_0^T(n),\tilde{d}_1^T(n),\dots,\tilde{d}_{N_M-1}^T(n))^T \tag{55}$$

$\underline{\tilde{d}}_m(n)$ can be determined according to formula 56:

$$\underline{\tilde{d}}_m(n)=\underline{W}_{01}^H F_{L_H}\tilde{d}_m(n) \tag{56}$$

such that the wave domain error signal in the DFT-domain can be determined by:

$$\underline{\tilde{e}}_m(n)=\underline{\tilde{d}}_m(n)-\underline{W}_{01}^H\underline{W}_{01}\underline{\tilde{X}}_m(n)\underline{\check{h}}_m(n-1) \tag{57}$$

The matrices $$\underline{W}_{01}=F_{L_H}(0,E_{L_H})F_{2L_H}^{-1}, \tag{58}$$

$$\underline{W}_{10}=B\mathrm{diag}^{N_H}\{F_{2L_H}(E_{L_H}(E_{L_H},0)^T F_{L_H}^{-1}\} \tag{59}$$

are used for realizing a windowing in the time domain. The vector $\underline{\tilde{h}}_m(n)$ comprises the representation of the impulse responses comprised in $\tilde{H}_{m,l}(n)$ for the corresponding l' in the DFT-domain.

The error-signal in time-domain can be determined by employing formula 60:

$$\tilde{e}_m(n)=F_{L_H}^{-1}\underline{W}_{01}\underline{\tilde{e}}_m(n) \tag{60}$$

wherein $$\tilde{e}(n)=(\tilde{e}_0^T(n),\tilde{e}_1^T(n),\ldots,\tilde{e}_{N_M-1}^T(n))^T \tag{61}$$

represents the error of all wavefield components.

For minimizing the squared error, which is exponentially weighted with the "forgetting factor" $\lambda_{SI}$, and which is represented by cost function:

$$J_m(n) = (1-\lambda_{SI})\sum_{i=0}^{n}\lambda_{SI}^{n-i}\tilde{e}_m^H(i)\tilde{e}_m(i) \tag{62}$$

the following algorithm has been presented in [5]:

$$\underline{\vec{h}}_m(n)=\underline{\vec{h}}_m(n-1)+\mu_{SI}(1-\lambda_{SI})\underline{W}_{10}\underline{W}_{10}^H\underline{S}_m^{-1}(n)\underline{\vec{X}}_m^H(n)\underline{\tilde{e}}_m(n) \tag{63}$$

with the selectable step width $0\leq\mu_{SI}\leq 1$, wherein $\underline{S}_m(n)$ is defined by formula 64:

$$\underline{S}_m(n)=\lambda_{SI}\underline{S}_m(n-1)+(1-\lambda_{SI})\underline{\tilde{X}}_m^H(n)\underline{W}_{01}^H\underline{W}_{01}\underline{\tilde{X}}_m(n) \tag{64}$$

The matrix $\underline{S}_m(n)$ can be approximated by a sparsely occupied matrix, which results in a significantly reduced computational complexity compared to a complete implementation of formula 64.

$\underline{S}_m(n)$ is usually singular for the reproduction scenarios considered here, or, is a structure, which makes regularization of $\underline{S}_m(n)$ a necessity. The regularization of the arithmetic means of all diagonal entries in $\underline{S}_m(n)$, which correspond to the considered wavefield components, are determined separately for all DFT-points. The results are then weighted by factor $\beta_{SI}$ and are then added to the diagonal entries separately for all DFT-points that have been used for calculating the respective arithmetic means. The matrix obtained by this is then used in formula 63 instead of $\underline{S}_m(n)$.

In the following, the determination of the prefilters by employing the filtered-X variant of the GFDAF algorithm is presented.

Comparable to the system identification as described above, for determining the prefilters, the error between the desired (predetermined) signal d(n) and the signal y(n) is minimized with respect to the square. However, as all prefilter coefficients influence all coefficients of the error:

$$\dot{e}(n)=\dot{d}(n)-\dot{y}(n) \tag{65}$$

a separation with respect to the index m of the error signal is, however, not possible.

To realize the simplified structure presented above, a limited number of prefilters are determined, which are represented by the prefilters:

$$g_{l',l}(n)=(g_{l',l}(0,n),g_{l',l}(1,n),\ldots,g_{l',l}(L_G-1,n))^T \tag{66}$$

Here, $g_{l',l}(k,n)$ represents the k-th time sample value of the impulse response of the prefilter, which maps the wavefield component l in $\tilde{x}(n)$ to the wavefield component l' in $\tilde{x}'(n)$.

To simplify the determination of the prefilter coefficients, we consider the individual wavefield components $\tilde{x}_l(n)$ in $\tilde{x}(n)$ separately.

By this, it is necessitated that not only the superposition of all filtered wavefield components that are filtered by the prefilters and the LEMS have to be adjusted, such that they are free of disturbances caused by the room, but also that each individual component is then free of disturbances caused by the room.

By this, a vector $\underline{g}_l(n)$ can be generated for each wavefield component $\tilde{x}_l(n)$ wherein the vector $\underline{g}_l(n)$ comprises all relevant prefilter coefficients in the DFT-domain. By this, $\underline{g}_l(n)$ is defined by:

$$\underline{g}_1(n)=((F_{L_G}g_{0,1}(n))^T,(F_{L_G}g_{1,1}(n))^T(F_{L_G}g_{2,1}(n))^T)^T \tag{67}$$

when only the prefilter $g_{0,1}(k,n)$, $g_{1,1}(k,n)$ and $g_{2,1}(k,n)$ shall be determined, if l=1. For illustrative purposes, it is now assumed that $N_G$ of such prefilters shall be determined for each component l.

For a greater computational efficiency, for each index l, only a subportion of all perceivable components of the error $\dot{e}(n)$ are considered. By this, for $\dot{e}_l(n)$ in the DFT-domain, we obtain e.g.:

$$\underline{\ddot{e}}_1(n)=\underline{\dot{\dot{W}}}_{01}^H((F_{L_F}\dot{e}_0(n))^T,(F_{L_F}\dot{e}_1(n))^T,(F_{L_F}\dot{e}_2(n))^T)^T \tag{68}$$

if the components indicated by l=1 in m=0,1,2 are considered for $\dot{e}(n)$. For illustrative purposes, we assume that all l have the same number $N_E$ of such components. As already done for system identification, we also define the matrices for windowing in the time domain in the respective dimensions:

$$\underline{\dot{\dot{W}}}_{01}=B\mathrm{diag}^{N_E}\{F_{L_G}(0,E_{L_G})F_{2L_G}^{-1}\}, \tag{69}$$

$$\underline{\dot{\dot{W}}}_{10}=B\mathrm{diag}^{N_G}\{F_{2L_G}(E_{L_G},0)^TF_{L_G}^{-1}\}. \tag{70}$$

We define by $\underline{\dot{d}}_l(n)$ an equivalent of $\underline{\ddot{e}}_l(n)$ for the desired (predetermined) signal. By this, the error $\underline{\ddot{e}}_l(n)$ results for each index l:

$$\underline{\ddot{e}}_l(n)=\underline{\dot{d}}_l(n)-\underline{\dot{\dot{W}}}_{01}\underline{\dot{\dot{W}}}_{01}\underline{g}_l(n)\underline{g}_l(n) \tag{71}$$

wherein the matrix $\underline{X}_l(n)$ again results from the relevant components of $\mathring{x}'(n)$. The representation in the DFT-domain of $\mathring{x}'(n)$ is given by:

$$\underline{g}_{m,l',l}(n)=\mathrm{Diag}\{F_{2L_G}\mathring{x}_{m,l',l}(n)\} \tag{72}$$

For the above-described example of $\underline{\ddot{e}}_1(n)$ and $\underline{g}_1(n)$, $\underline{g}_1(n)$ is:

$$\mathring{X}_1(n)=\begin{pmatrix}\mathring{X}_{0,0,1}(n) & \mathring{X}_{0,1,1}(n) & \tilde{X}_{0,2,1}(n)\\ \mathring{X}_{1,0,1}(n) & \mathring{X}_{1,1,1}(n) & \mathring{X}_{1,2,1}(n)\\ \mathring{X}_{2,0,1}(n) & \mathring{X}_{2,1,1}(n) & \mathring{X}_{2,2,1}(n)\end{pmatrix} \tag{73}$$

Similar to the GFDAF presented above, we want to achieve a minimization of the cost function $$\mathring{J}_l(n) = (1-\lambda_{FX})\sum_{i=0}^{n}\lambda_{FX}^{n-i}\mathring{e}_l^H(i)\mathring{e}_l(i),\ \forall\, l \tag{74}$$

by suitable $\underline{g}_l(n)$.

Similarly as explained in [5], the adaptation rule for the solution of this optimization problem is defined by formula 75:

$$\underline{g}_l(n)=\underline{g}_l(n-1)+\mu_{FX}(1-\lambda_{FX})\underline{\dot{\dot{W}}}_{10}\underline{\dot{\dot{W}}}_{10}^H\underline{\dot{S}}_l^{-1}(n)\underline{g}_l^H(n)\underline{\ddot{e}}_l(n) \tag{75}$$

with the selectable step width $0 \leq \mu_{FX} \leq 1$ and $$\dot{\underline{S}}_l(n) = \lambda_{FX} \dot{\underline{S}}_l(n-1) + (1-\lambda_{FX}) \underline{g}_l^H(n) \ddot{\underline{W}}_{01}^H \ddot{\underline{W}}_{01} \underline{g}_l(n) \quad (76)$$

Here, formula 75 and formula 76 are similar to formula 63 and formula 64, respectively, such that the concepts for regularization and for efficient calculation of the conventional GFDAF can also the used for the filtered-X variant. The different structures of the matrices and vectors involved, however, result in a different algorithm.

Figure 10A:
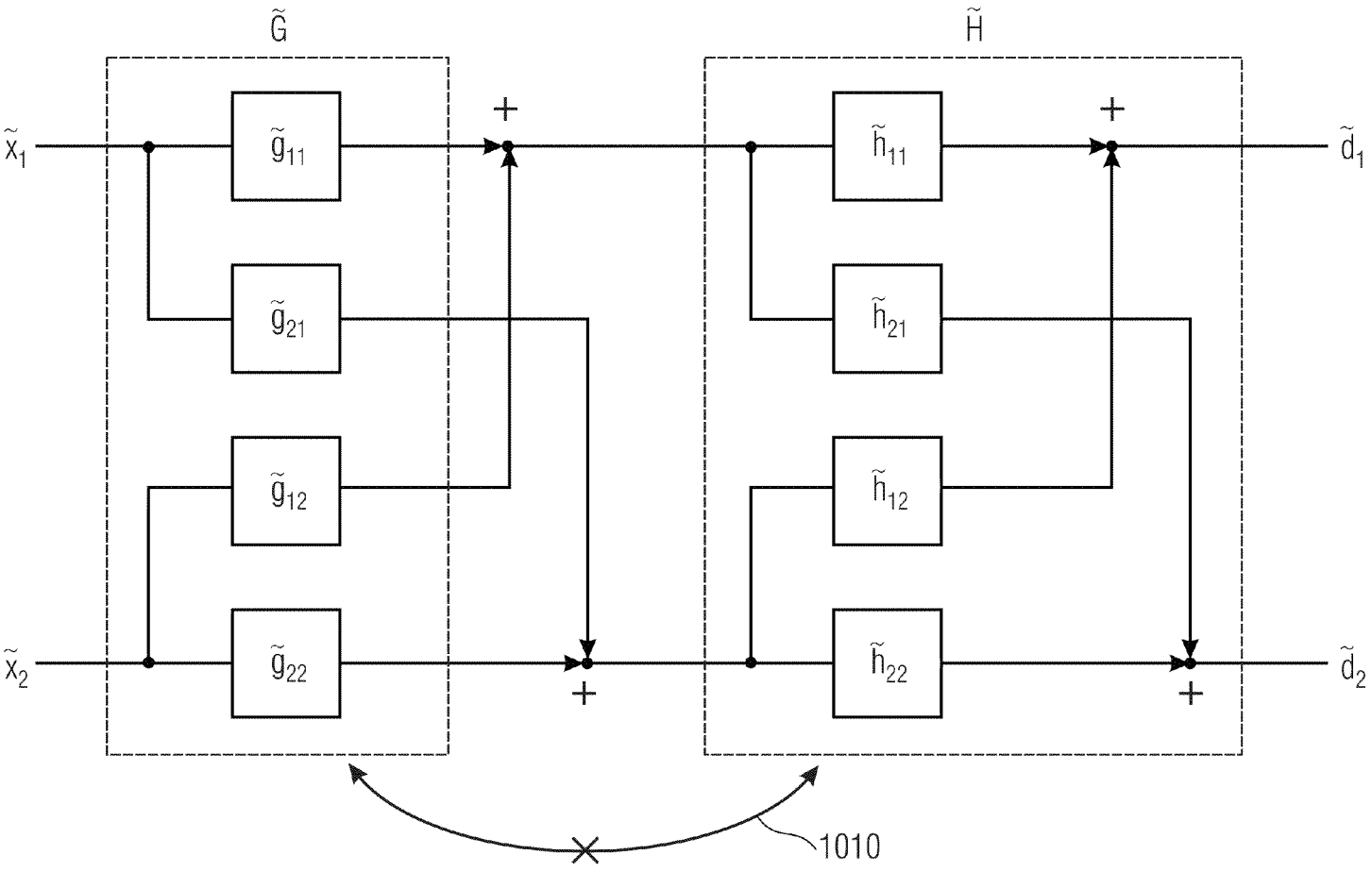
FIG. 10*a* illustrates an arrangement of $\tilde{G}(n)$ and $\tilde{H}(n)$, wherein $\tilde{G}(n)$ and $\tilde{H}(n)$ cannot be arranged in reverse order.
Figure 10B:
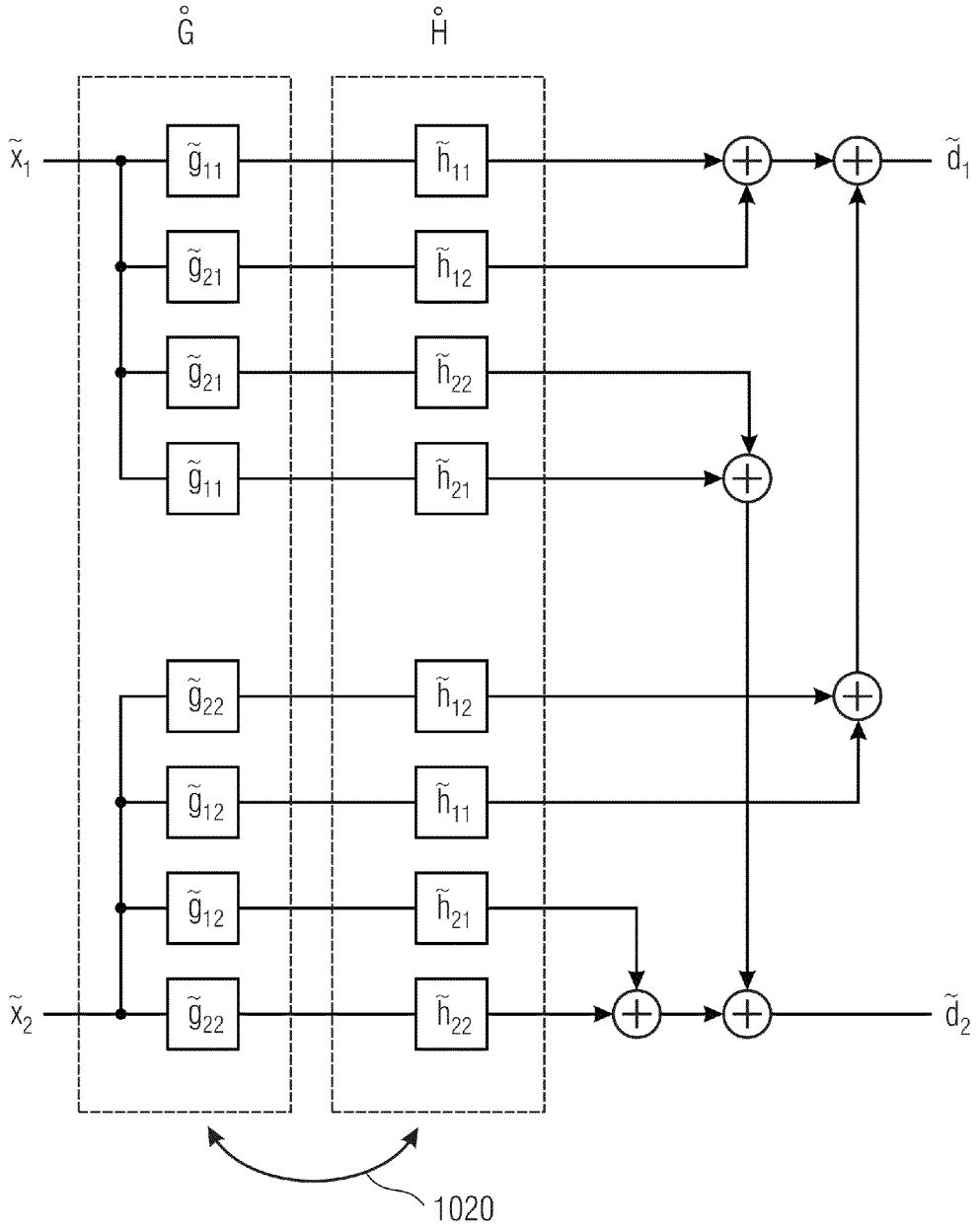
FIG. 10*b* illustrates an arrangement of $\tilde{G}(n)$ and $\tilde{H}(n)$, wherein $\tilde{G}(n)$ and $\tilde{H}(n)$ can be arranged in reverse order.

FIGS. 10*a* and 10*b* illustrate, why the structure of $\tilde{G}(n)$ and $\tilde{H}(n)$ may have to be adapted, when $\tilde{G}(n)$ and $\tilde{H}(n)$ are arranged in reverse order.

In FIG. 10*a*, $\tilde{G}(n)$ and $\tilde{H}(n)$ have a structure such that $\tilde{G}(n)$ and $\tilde{H}(n)$ cannot be arranged in reverse order without changing the output of the filtered loudspeaker signals $\tilde{d}_1$ and $\tilde{d}_2$. This is indicated by arrow 1010.

In contrast, FIG. 10*b* provides $\overset{0}{G}(n)$ and $\overset{0}{H}(n)$ having a structure such that $\overset{0}{G}(n)$ and $\overset{0}{H}(n)$ can be arranged in reverse order without changing the output of the filtered loudspeaker signals $\tilde{d}_1$ and $\tilde{d}_2$. This is indicated by arrow 1020.

It should be noted that even in a simple arrangement, e.g. the arrangements of FIGS. 10*a* and 10*b*, each system block of $\tilde{G}(n)$ and $\tilde{H}(n)$ has to be provided two times for $\overset{0}{H}(n)$ and $\overset{0}{G}(n)$ For real systems this results in an increased amount if computation time.

As has already been stated above, each matrix coefficient of the filter matrix $\tilde{G}(n)$ can be regarded as a filter coefficient for a loudspeaker signal pair of one of the transformed loudspeaker signals and one of the filtered loudspeaker signals, as the respective matrix coefficient describes, to what degree the corresponding transformed loudspeaker signal influences the corresponding filtered loudspeaker signal that will be generated.

Moreover, as has been described above, according to embodiments of the present invention, not all coefficients of the filter matrix $\tilde{G}(n)$ are needed for filtering the transformed loudspeaker signals to obtain the filtered loudspeaker signals.

Thus, according to an embodiment, the filter adaptation unit 130 of FIG. 1 may be configured to determine a filter coefficient for each pair of at least three pairs of a loudspeaker signal pair group to obtain a filter coefficients group, the loudspeaker signal pair group comprising all loudspeaker signal pairs of one of the transformed loudspeaker signals and one of the filtered loudspeaker signals, wherein the filter coefficients group has fewer filter coefficients than the loudspeaker signal pair group has loudspeaker signal pairs. The filter adaptation unit 130 may be configured to adapt the filter 140 of FIG. 1 by replacing filter coefficients of the filter 140 by at least one of the filter coefficients of the filter coefficients group.

For example, at first, the filter adaptation unit 130 determines some, but not all, matrix coefficients of the matrix d(n). These matrix coefficients then form the filter coefficients group. The other matrix coefficients, that have not been determined by the filter adaptation unit 130 will not be considered and will not be used when generating the filtered loudspeaker signals (the matrix coefficients that have not been determined can be assumed to be zero).

In an alternative embodiment, the filter adaptation unit 130 of FIG. 1 may be configured to determine a filter coefficient for each pair of a loudspeaker signal pair group to obtain a first filter coefficients group, the loudspeaker signal pair group comprising all loudspeaker signal pairs of one of the transformed loudspeaker signals and one of the filtered loudspeaker signals. The filter adaptation unit 130 may be configured to select a plurality of filter coefficients from the first filter coefficients group to obtain a second filter coefficients group, the second filter coefficients group having fewer filter coefficients than the first filter coefficients group. Moreover, the filter adaptation unit 130 may be configured to adapt the filter 140 by replacing the filter coefficients of the filter 140 by at least one of the filter coefficients of the second filter coefficients group.

For example, at first, the filter adaptation unit 130 determines all matrix coefficients of the matrix $\tilde{G}(n)$. These matrix coefficients then form the first filter coefficients group. However, some of the matrix coefficients will not be used when generating the filtered loudspeaker signals. The filter adaptation unit 130 selects only those filter coefficients of the first filter coefficients group as members of the second filter coefficients group, that shall be used for generating the filtered loudspeaker signals. For example, all matrix coefficients of the filter matrix $\tilde{G}(n)$ will be determined (determining the first filter coefficients group), but some of the matrix coefficients will be set to zero afterwards (the matrix coefficients that have not been set to zero then form the second filter coefficients group).

The advantage of the wave-domain description is the immediate spatial interpretation of all signal quantities and filtered coefficients, which can be exploited in various ways. In [14], an approximate model for the LEMS model was successfully used for a computationally efficient AEC. This approach exploits the fact that the couplings of the wave field components described by $\tilde{x}'(n)$ and $\tilde{d}(n)$ are significantly stronger for components with a low difference $|m-l'|$ in the mode order [14]. For AEC it has been shown that modeling the coupling with $l'=m$ alone is sufficient for scenarios where a WFS system is synthesizing the wave field of a single source, see

[7] H. Buchner, S. Spors, and W. Kellermann, "Wave-domain adaptive filtering: acoustic echo cancellation for full-duplex systems based on wave-field synthesis", in Proc. Int. Conf. Acoust. Speech, Signal Process. (ICASSP), May 2004, vol. 4, pp. IV-117-IV-120, while this model is not sufficient when multiple virtual sources are active [14]. In the latter case, a systematic correction of the system behavior as necessitated for LRE is not possible, as the actual behavior is not sufficiently modeled. Therefore, we propose change the LEM model described in [15] to a structure as shown under FIG. 11*b*, which constitutes an approximation of the model shown under FIG. 11*a*.

Figure 11A:
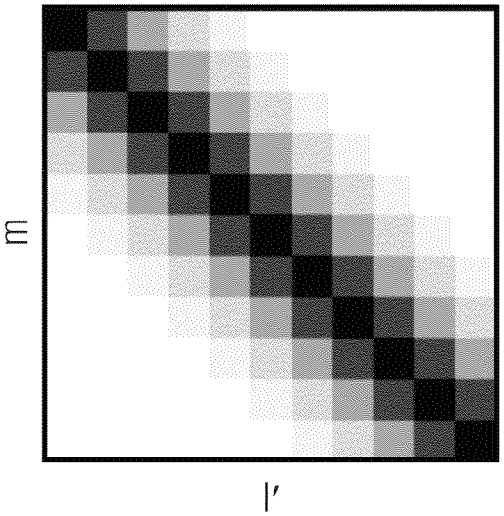
FIG. 11*a-c* depict exemplary illustrations of the LEMS model and resulting equalizer weights.
Figure 11B:
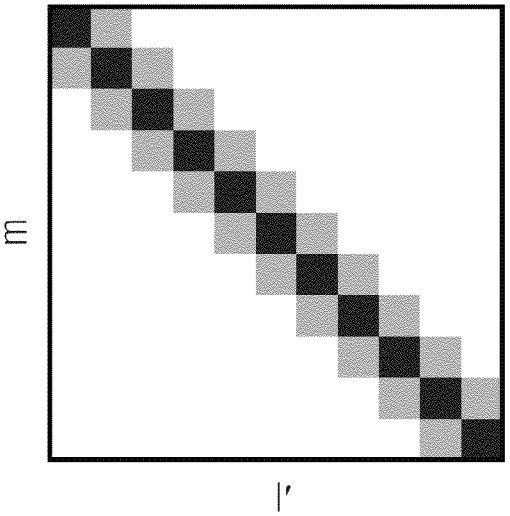
Figure 11C:
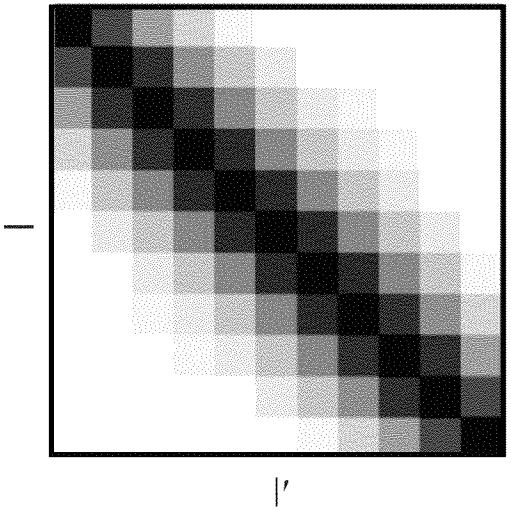

FIG. 11*a-c* are exemplary illustrations of LEMS model and resulting equalizer weights. FIG. 11*a* illustrates weights of couplings in $T_2 H T_1^{-1}$. FIG. 11*b* illustrates couplings modeled in $\tilde{H}(n)$ with $|m-l'|<2$ ($N_D=3$).

FIG. 11*c* illustrates resulting weights of the equalizers $\tilde{G}(n)$ considering only $\tilde{H}(n)$. Again, we approximate the structure of $\tilde{G}(n)$ as shown under FIG. 11*c* by the most important equalizers resulting in a structure identical to the one shown in FIG. 11*b*.

The proposed concepts have been evaluated for filtering structures of a varying complexity along with considering the robustness to varying listener positions. For evaluation of the proposed scheme, room impulse responses for H were calculated using a first order image source model for the setup depicted in FIG. 5 with $R_L=1.5$ m, $R_M=0.5$ m, $D_1=D_4=2$ m, $D_2=D_3=3$ m, $N_L=N_M=48$ and a reflection factor of 0.9. The radii of the arrays were chosen so that the wave field in between the microphone and loudspeaker array circles may also be observed over a broad area. Operating at a sampling rate of $f_s=2$ kHz, the spatial aliasing of the WFS system is not significant and the obtained impulse responses have a length of less than 64 samples, although the adaptive filters in $\tilde{H}(n)$ were able to model a length of $L_H$=129 samples. This choice for $L_H$ accounts for an artificial delay of 40 samples introduced in $\tilde{H}_0=T_2H_0T_1^{-1}$ to improve convergence (with $H_0$ describing the free-field response for the setup). The length of the equalizer impulse response was chosen to $L_G$=256 samples. For both GFDAF algorithms a forgetting factor of 0.95 and a frame shift of $L_F$=129 samples were used. The normalized step size for the filtered-X GFDAF was 0.2.

Figure 12:
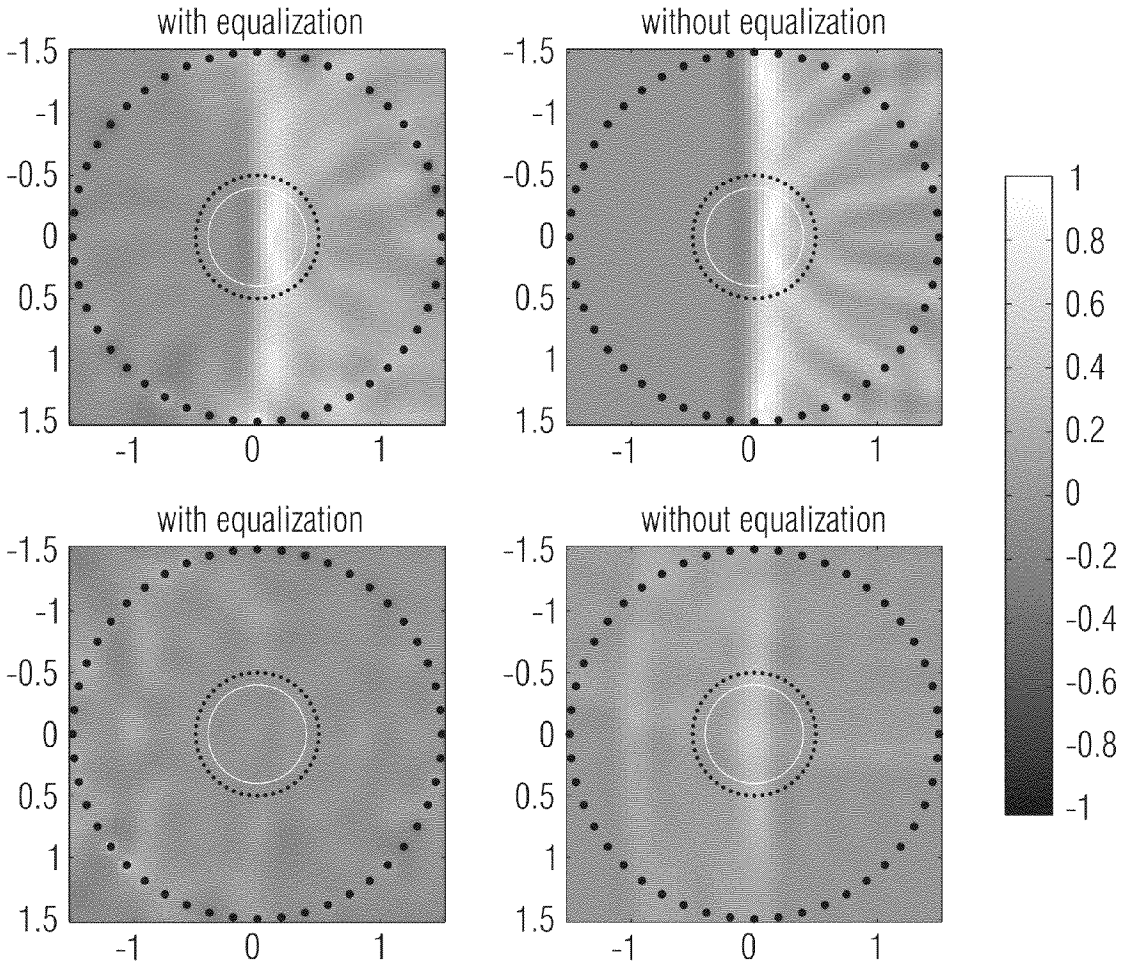
FIG. 12 illustrates normalized sound pressure of a synthesized plane wave within a room.

FIG. 12 shows normalized sound pressure of a synthesized plane wave within a room. The result with and without LRE is shown in the left and right column, respectively. The illustrations in the upper row show the direct component emitted by the loudspeakers. The illustrations in the lower row show the portions reflected by the walls. The scale is meters.

To assess the achieved LRE, the difference of the actually measured wave field to the wave field under free-field conditions was calculated. The resulting value was then normalized to the value which would be obtained without equalization:

$$e_{MA}(n) = 10\log_{10}\left(\frac{\left\|(T_2HT_1^{-1}\tilde{G}(n) - \tilde{H}_0)\tilde{x}(n)\right\|_2^2}{\left\|(T_2HT_1^{-1}\tilde{I} - \tilde{H}_0)\tilde{x}(n)\right\|_2^2}\right)\text{dB}, \tag{79}$$

where $\tilde{I}$ does not alter the signal, but insures consistent vector lengths and $\|\cdot\|^2$ is the Euclidian norm. To assess the spatial robustness of the approach, we measure the error $e_{LA}$ within the listening area which is the area enclosed by the microphone array. The LRE error in the listening area $e_{LA}$ is determined in the same way as $e_{MA}$, but with a microphone array of a radius of $R_M$=0.4 m as shown by the white circle in FIG. 12.

The loudspeaker signals x were determined according to the theory of WFS, for simultaneously synthesizing three plane waves with the incidence angles $\phi_1=0$, $\phi_2=\pi/2$ and $\phi_3=\pi$, where mutually uncorrelated white noise signals were used for the sources.

The evaluated structures differ in the number of modeled mode couplings in $\tilde{H}(n)$ and corresponding equalizers in $\tilde{G}(n)$. For each wave field component in $\tilde{x}'(n)$ the couplings to $N_D$ components in $\tilde{d}(n)$ through $\tilde{H}(n)$ were modeled according to $|m-l|<\text{ceil}(N_D/2)$. The structure of the equalizers in $\tilde{G}$ were chosen in the same way: for each mode in $\tilde{x}(n)$, the equalizers to the $N_D$ modes were determined in $\tilde{x}'(n)$ with $|l'-l|<\text{ceil}(N_D/2)$.

Figure 13:
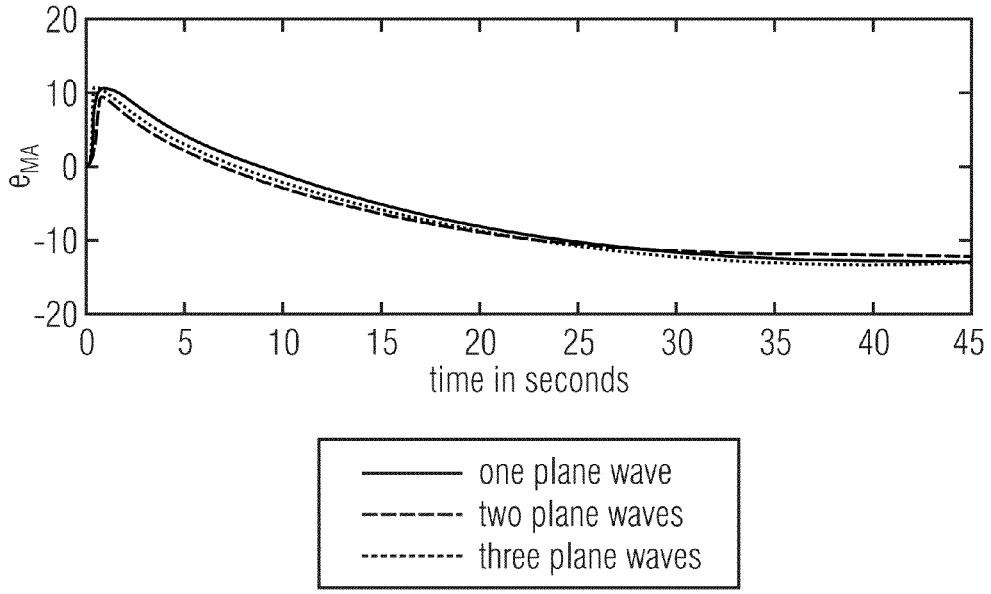
FIG. 13 illustrates a convergence over time for an LRE system with $N_D$=3 for different scenarios.
Figure 13:
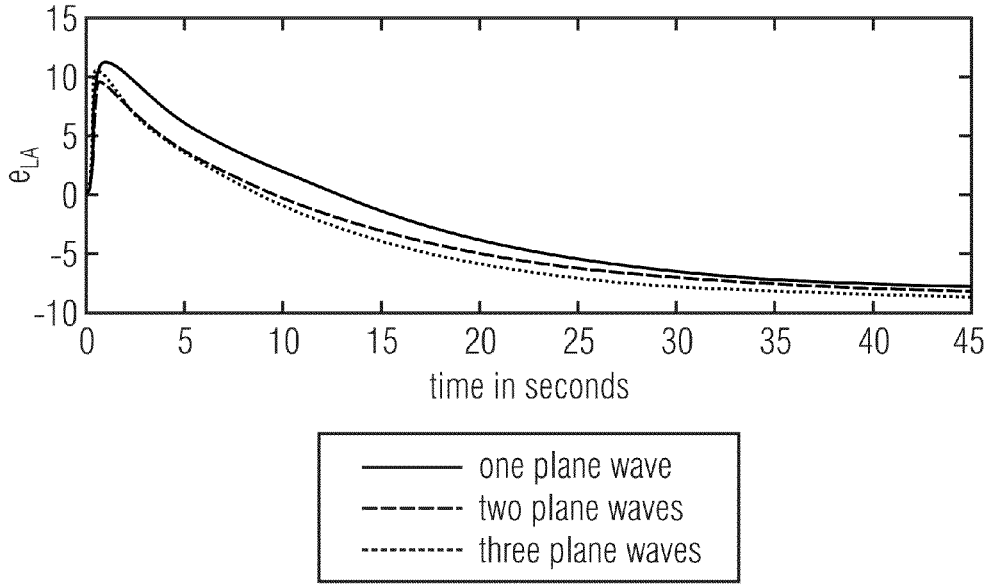

In FIG. 13, the LRE errors over time for a system with $N_D$=3 can be seen. The convergence over time for an LRE system with $N_D$=3 for different scenarios is depicted. The upper plot shows the LRE performance at the microphone array, the lower plot within the listening area. $e_{MA}$ means error at the microphone array. $e_{LA}$ means error in the listening area.

In FIG. 13, it is depicted that after a short phase of the divergence of the system stabilizes and converges towards an error of approximately $e_{MA}$=13 dB. The initial divergence is due to a poorly identified system H in the beginning. In practical systems one would wait with determining $\tilde{G}(n)$ until $\tilde{H}(n)$ has been sufficiently well identified. A slightly better convergence for the examples with two or three plane waves can also be explained through a better identification of H, as the loudspeaker signals are less correlated for an increased number of synthesized plane waves. It can be seen that the error in the listening area shows the same behavior as the error at the position of the microphone array, although the remaining error is about 5 dB larger. This shows that for the chosen array setup a solution for the circumference of the microphone array may be interpolated towards the center of the microphone array, e.g. the listening area.

FIG. 12 shows an example for an impulse-like plane wave with an incidence angle of $\phi_1=0$ for the converged equalizers. It can be seen that the equalizers preserve the wave shape (upper left plot) and compensate for reflections within the listening area (lower left plot), while the wave field outside the listening area is somewhat distorted. This is not surprising as the wave field outside the listening area is not enclosed by the microphone array and is therefore not optimized. This effect is stronger for larger values of $N_D$, suggesting to apply additional constraints on the equalizer coefficients to suppress it.

Figure 14:
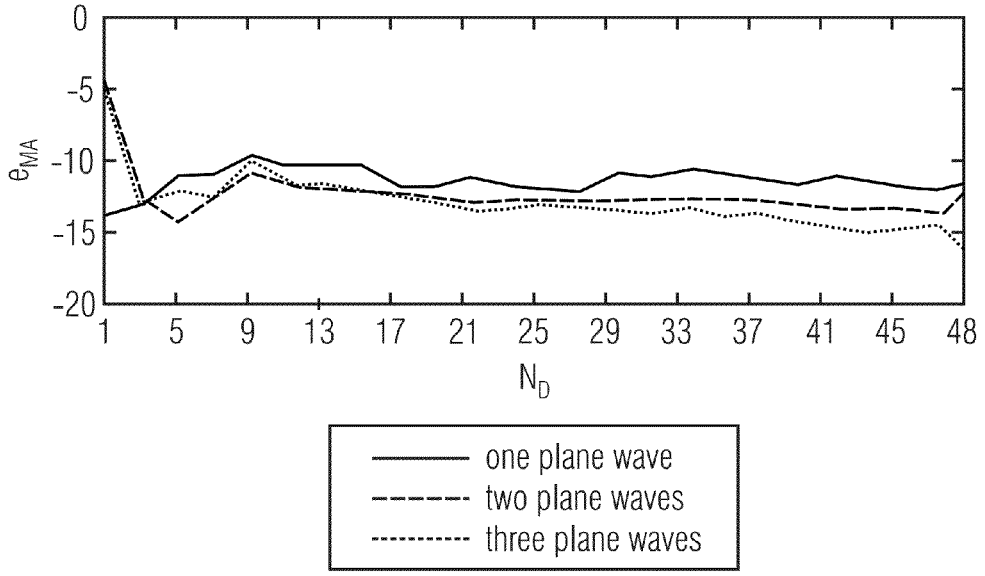
FIG. 14 illustrates an LRE error after convergence for different equalizer structures.
Figure 14:
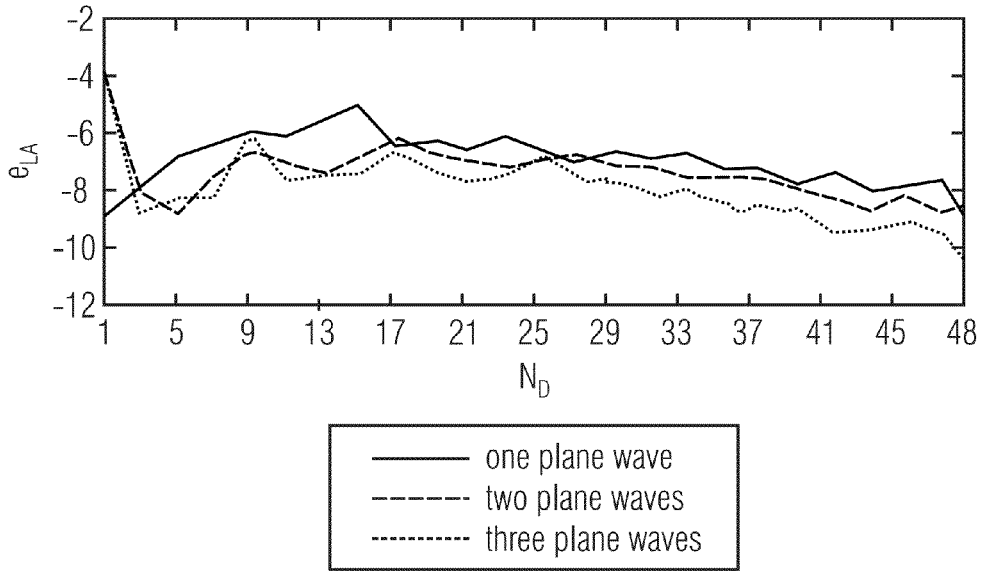

In FIG. 14, the errors $e_{MA}$ and $e_{LA}$ can be seen after convergence for structures with a different $N_D$. For the scenario with one synthesized plane wave denoted by the solid line, it can be seen that actually the simplest structure with $N_D$=1 shows the best performance. Although the other structures with $N_D$>1 have more degrees of freedom, they cannot take advantage of it because the underlying inverse filtering problem is ill-conditioned. On the other hand, for the more complex scenarios with two or three synthesized plane waves, denoted by the dashed and the dotted line, respectively, the structure with $N_D$=1 does not have sufficient degrees of freedom and the more complex structures perform significantly better.

An adaptive LRE in the wave-domain is provided by considering the relations between wave-field components of different orders. It has been shown that the necessitated complexity and optimum performance of the LRE structure is dependent on the complexity of the reproduced scene. Moreover, the underlying inverse filtering problem is strongly ill-conditioned, suggesting to choose the number of degrees of freedom as low as possible. Due to the scalable complexity, the proposed system exhibits lower computational demands and a higher robustness compared to conventional systems, while it is also suitable for a broader range of reproduction scenarios.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] A. J. Berkhout, D. De Vries, and P. Vogel, "Acoustic control by wave field synthesis", J. Acoust. Soc. Am., vol. 93, pp. 2764-2778, May 1993.

[2] J. Benesty, D. R. Morgan, and M. M. Sondhi, "A better understanding and an improved solution to the specific problems of stereophonic acoustic echo cancellation", IEEE Trans. Speech Audio Process, vol. 6, no. 2, pp. 156-165, March 1998.

[3] T. Betlehem and T. D. Abhayapala, "Theory and design of sound field reproduction in reverberant rooms", J. Acoust. Soc. Am., vol. 117, no. 4, pp. 2100-2111, April 2005.

[4] Buchner, H.; Benesty, J.; Gänsler, T.; Kellermann, W.: Robust Extended Multidelay Filter and Double-Talk Detector for Acoustic Echo Cancellation. In: *Audio, Speech, and Language Processing, IEEE Transactions on* 14 (2006), Nr. 5, S. 1633-1644.

[5] Buchner, H.; Benesty, J.; Kellermann, W.: Multichannel Frequency-Domain Adaptive Algorithms with Application to Acoustic Echo Cancellation. In: Benesty, J. (Hrsg.); Huang, Y. (Hrsg.): *Adaptive Signal Processing: Application to Real-World Problems*. Berlin (Springer, 2003).

[6] Buchner, H.; Herbodt, W.; Spors, S; Kellermann, W.: US-Patent Application: Apparatus and Method for Signal Processing. Pub. No.: US 2006 0262939 A1, November 2006.

[7] H. Buchner, S. Spors, and W. Kellermann, "Wave-domain adaptive filtering: acoustic echo cancellation for full-duplex systems based on wave-field synthesis", in Proc. Int. Conf. Acoust. Speech, Signal Process. (ICASSP), May 2004, vol. 4, pp. IV-117-IV-120.

[8] S. Goetze, M. Kallinger, A. Merlins, and K. D. Kammeyer, "Multi-channel listening-room compensation using a decoupled filtered-X LMS algorithm", in Proc. Asilomar Conference on Signals, Systems and Computers, October 2008, pp. 811-815.

[9] Haykin, S.: *Adaptive filter theory*. Englewood Cliffs, N.J., 2002.

[10] Lopez, J. J.; Gonzalez, A.; Fuster, L.: Room compensation in wave field synthesis by means of multichannel inversion. In: *Applications of Signal Processing to Audio and Acoustics,* 2005. *IEEE Workshop on,* 2005, S. 146-149.

[11] P. A. Nelson, F. Orduna-Bustamante, and H. Hamada, "Inverse filter design and equalization zones in multichannel sound reproduction", IEEE Trans. Speech Audio Process, vol. 3, no. 3, pp. 185-192, May 1995.

[12] Omura, M.; Yada, M.; Saruwatari, H.; Kajita, S.; Takeda, K.; Itakura, F.: Compensating of room acoustic transfer functions affected by change of room temperature. In: *Acoustics, Speech, and Signal Processing,* 1999. *ICASSP '99. Proceedings.,* 1999 *IEEE International Conference on* Bd. 2 IEEE, 1999, S. 941-944.

[13] M. Schneider and W. Kellermann, "A wave-domain model for acoustic MIMO systems with reduced complexity", in Proc. Joint Workshop on Hands-free Speech Communication and Microphone Arrays (HSCMA), Edinburgh, UK, May 2011.

[14] Schneider, M.; Kellermann, W.: A Wave-Domain Model for Acoustic MIMO Systems with Reduced Complexity. In: *Proc. Joint Workshop on Hands-free Speech Communication and Microphone Arrays* (*HSCMA*). Edinburgh, UK, May 2011.

[15] S. Spors, H. Buchner, and R. Rabenstein, "A novel approach to active listening room compensation for wave field synthesis using wave-domain adaptive filtering" in Proc. Int. Conf. Acoust. Speech, Signal Process (ICASSP), May 2004, vol. 4, pp. IV-29-IV-32.

[16] Spors, S.; Buchner, H.; Rabenstein, R.; Herbordt, W.: Active Listening Room Compensation for Massive Multichannel Sound Reproduction Systems Using Wave-Domain Adaptive Filtering. In: *J. Acoust. Soc. Am.* 122 (2007), July, Nr. 1, S. 354-369.

The invention claimed is:

1. An apparatus for listening room equalization, wherein the apparatus is adapted to receive a plurality of loudspeaker input signals, and wherein the apparatus comprises:

a first transform unit for transforming the at least two loudspeaker input signals from a time domain to a wave domain to acquire a plurality of transformed loudspeaker signals, a system identification adaptation unit for adapting a first loudspeaker-enclosure-microphone system identification to acquire a second loudspeaker-enclosure-microphone system identification, wherein the first and the second loudspeaker-enclosure-microphone system identification identify a loudspeaker-enclosure-microphone system comprising a plurality of loudspeakers and a plurality of microphones, a filter, wherein the filter comprises a plurality of subfilters for generating a plurality of filtered loudspeaker signals, an inverse transform unit for transforming the plurality of filtered loudspeaker signals from the wave domain to the time domain to acquire filtered time-domain loudspeaker signals and for feeding the filtered time-domain loudspeaker signals into the plurality of loudspeakers of the loudspeaker-enclosure-microphone system, a filter adaptation unit for adapting the filter based on the second loudspeaker-enclosure-microphone system identification and based on a predetermined loudspeaker-enclosure-microphone system identification, wherein the system identification adaptation unit is configured to adapt the first loudspeaker-enclosure-microphone system identification based on an error indicating a difference between a plurality of transformed microphone signals and a plurality of estimated microphone signals, wherein the plurality of transformed microphone signals and the plurality of estimated microphone signals depend on the plurality of the filtered loudspeaker signals, wherein the filter is defined by a first matrix $\tilde{G}(n)$, wherein the first matrix $\tilde{G}(n)$ comprises a plurality of first matrix coefficients, wherein the filter adaptation unit is configured to adapt the filter by adapting the first matrix $\tilde{G}(n)$, and wherein the filter adaptation unit is configured to adapt the first matrix $\tilde{G}(n)$ by setting one or more of the plurality of first matrix coefficients to zero, a second transform unit for receiving a plurality of microphone signals as received by the plurality of microphones and for transforming a plurality of microphone signals of the loudspeaker-enclosure-microphone system from a time domain to a wave domain to acquire the plurality of transformed microphone signals, and a loudspeaker-enclosure-microphone system estimator for generating the plurality of estimated microphone signals based on the first loudspeaker-enclosure-microphone system identification and based on the plurality of the filtered loudspeaker signals, wherein each subfilter of the subfilters is arranged to receive one or more of the transformed loudspeaker signals as received loudspeaker signals of said subfilter, and wherein each subfilter of the subfilters is furthermore adapted to generate one of the plurality of filtered loudspeaker signals based on the one or more received loudspeaker signals of said subfilter, wherein at least one subfilter of the subfilters is arranged to receive at least two of the transformed loudspeaker signals as the received loudspeaker signals of said subfilter, and is furthermore arranged to couple the at least two received loudspeaker signals of said subfilter to generate one of the plurality of the filtered loudspeaker signals of said subfilter, wherein at least one subfilter of the subfilters comprises a number of the received loudspeaker signals of said subfilter that is smaller than a total number of the plurality of transformed loudspeaker signals, the number of the received loudspeaker signals of said subfilter being one or greater than one, and wherein, when the number of the received loudspeaker signals of a subfilter of the at least one of the subfilters is greater than one, only the received loudspeaker signals of the subfilter of the at least one of the subfilters are coupled to generate the one of the plurality of the filtered loudspeaker signals.

2. An apparatus according to claim 1, wherein the filter adaptation unit is configured to determine a filter coefficient for each pair of at least three pairs of a signal pair group to acquire a filter coefficients group, the signal pair group comprising all loudspeaker signal pairs of one of the transformed loudspeaker signals and one of the filtered loudspeaker signals, wherein the filter coefficients group comprises fewer filter coefficients than the signal pair group comprises loudspeaker signal pairs, and wherein the filter adaptation unit is configured to adapt the filter by replacing filter coefficients of the filter by at least one of the filter coefficients of the filter coefficients group.

3. An apparatus according to claim 1, wherein the filter adaptation unit is configured to determine a filter coefficient for each pair of a signal pair group to acquire a first filter coefficients group, the signal pair group comprising all loudspeaker signal pairs of one of the transformed loudspeaker signals and one of the filtered loudspeaker signals, wherein the filter adaptation unit is configured to select a plurality of filter coefficients from the first filter coefficients group to acquire a second filter coefficients group, the second filter coefficients group comprising fewer filter coefficients than the first filter coefficients group, and wherein the filter adaptation unit is configured to adapt the filter by replacing filter coefficients of the filter by at least one of the filter coefficients of the second filter coefficients group.

4. An apparatus according to claim 1, wherein all subfilters of the filter receive the same number of transformed loudspeaker signals.

5. An apparatus according to claim 1, wherein the filter adaptation unit is configured to adapt the filter based on the equation $$\tilde{H}(n)\tilde{G}(n)=\tilde{H}^{(O)}$$

wherein $\tilde{H}(n)$ is a second matrix indicating the second loudspeaker-enclosure-microphone system identification, and wherein $\tilde{H}^{(O)}$ is a third matrix indicating the predetermined loudspeaker-enclosure-microphone system identification.

6. An apparatus according to claim 5, wherein the second matrix $\tilde{H}(n)$ comprises a plurality of second matrix coefficients, and wherein the system identification adaptation unit is configured to determine the second matrix $\tilde{H}(n)$ by setting one or more of the plurality of second matrix coefficients to zero.

7. An apparatus according to claim 1, wherein the apparatus furthermore comprises an error determiner for determining the error $\tilde{e}(n)$ indicating the difference between the plurality of transformed microphone signals and the plurality of estimated microphone signals by applying the formula $$\tilde{e}(n)=\tilde{d}(n)-\tilde{y}(n)$$

to determine the error, and wherein the error determiner is arranged to feed the determined error into the system identification adaptation unit.

8. A method for listening room equalization comprising:

receiving a plurality of loudspeaker input signals, transforming the at least two loudspeaker input signals from a time domain to a wave domain to acquire a plurality of transformed loudspeaker signals, adapting a first loudspeaker-enclosure-microphone system identification to acquire a second loudspeaker-enclosure-microphone system identification, wherein the first and the second loudspeaker-enclosure-microphone system identification identify a loudspeaker-enclosure-microphone system comprising a plurality of loudspeakers and a plurality of microphones, and adapting a filter based on the second loudspeaker-enclosure-microphone system identification and based on a predetermined loudspeaker-enclosure-microphone system identification, wherein the filter comprises a plurality of subfilters, wherein each subfilter of the subfilters is arranged to receive one or more of the transformed loudspeaker signals as received loudspeaker signals of said subfilter, and wherein each subfilter of the subfilters is furthermore adapted to generate one of a plurality of filtered loudspeaker signals based on the one or more received loudspeaker signals of said subfilter, and wherein adapting the first loudspeaker-enclosure-microphone system identification is conducted based on an error indicating a difference between a plurality of transformed microphone signals and a plurality of estimated microphone signals, wherein the plurality of transformed microphone signals and the plurality of estimated microphone signals depend on the plurality of the filtered loudspeaker signals, wherein the filter is defined by a first matrix $\tilde{G}(n)$, wherein the first matrix $\tilde{G}(n)$ comprises a plurality of first matrix coefficients, wherein adapting the filter is conducted by adapting the first matrix $\tilde{G}(n)$, and wherein the filter adaptation unit is configured to adapt the first matrix $\tilde{G}(n)$ by setting one or more of the plurality of first matrix coefficients to zero, transforming a plurality of microphone signals received by the plurality of microphones of the loudspeaker-enclosure-microphone system from a time domain to a wave domain to acquire the plurality of transformed microphone signals, and generating the plurality of estimated microphone signals based on the first loudspeaker-enclosure-microphone system identification and based on the plurality of the filtered loudspeaker signals, wherein at least one subfilter of the subfilters is arranged to receive at least two of the transformed loudspeaker signals as the received loudspeaker signals of said subfilter, and is furthermore arranged to couple the at least two received loudspeaker signals to generate one of the plurality of the filtered loudspeaker signals, wherein at least one subfilter of the subfilters comprises a number of the received loudspeaker signals of said subfilter that is smaller than a total number of the plurality of transformed loudspeaker signals, the number of the received loudspeaker signals of said subfilter being one or greater than one, and wherein, when the number of the received loudspeaker signals of a subfilter of the at least one of the subfilters is greater than one, only the received loudspeaker signals of the subfilter of the at least one of the subfilters are coupled to generate the one of the plurality of the filtered loudspeaker signals.

9. A non-transitory computer readable medium comprising a computer program for implementing a method according to claim 8 when being executed by a computer processor.

* * * * *